US012066261B2

(12) United States Patent
Henry

(10) Patent No.: US 12,066,261 B2
(45) Date of Patent: Aug. 20, 2024

(54) SAFETY SYSTEMS AND METHODS

(71) Applicant: Innervision by Henry, Minnetonka, MN (US)

(72) Inventor: John Junior Henry, Minnetonka, MN (US)

( * ) Notice: Subject to any disclaimer, the term of this patent is extended or adjusted under 35 U.S.C. 154(b) by 0 days.

(21) Appl. No.: 16/944,107

(22) Filed: Jul. 30, 2020

(65) Prior Publication Data

US 2021/0088297 A1 Mar. 25, 2021

Related U.S. Application Data

(60) Provisional application No. 62/880,516, filed on Jul. 30, 2019.

(51) Int. Cl.
*F41A 17/06* (2006.01)
*F41C 33/02* (2006.01)

(52) U.S. Cl.
CPC ..... *F41A 17/063* (2013.01); *F41C 33/029* (2013.01)

(58) Field of Classification Search
CPC ..... F41A 17/063; F41C 33/029
See application file for complete search history.

(56) References Cited

U.S. PATENT DOCUMENTS 5,479,149 A * 12/1995 Pike ..... F41C 33/0209 340/539.1
5,779,114 A * 7/1998 Owens ..... F41C 33/0209 224/193
6,529,126 B1 3/2003 Henry
6,831,556 B1 12/2004 Boykin
6,933,839 B2 8/2005 Henry
7,768,548 B2 8/2010 Silvernail et al.
8,781,475 B1 7/2014 McKeeman et al.
9,246,898 B2 1/2016 McKeeman et al.
9,432,402 B1 8/2016 Kazachkov et al.
10,230,919 B2 3/2019 Davis et al.
10,764,542 B2 * 9/2020 Stewart ..... H04N 7/185
2015/0254968 A1 * 9/2015 Sanders ..... G08B 25/016 340/539.13
2017/0248388 A1 * 8/2017 Young ..... F41A 19/01
2018/0100713 A1 * 4/2018 Patches ..... F41C 33/029
2018/0238649 A1 * 8/2018 Winiecki ..... F41C 33/029
2019/0137215 A1 * 5/2019 Bernkrant ..... F41C 33/029
2019/0195586 A1 * 6/2019 Milde, Jr. ..... F41A 17/063
2019/0295404 A1 * 9/2019 Schuler ..... G08B 21/18

OTHER PUBLICATIONS

Body Worn by Utility Associates, Inc., Body Worn Police Camera Online Product Description, https://www.bodyworn.com/bodyworn/police-camera; 10 pages.

* cited by examiner

*Primary Examiner* — Joshua E Freeman
(74) *Attorney, Agent, or Firm* — Faegre Drinker Biddle & Reath LLP

(57) ABSTRACT

A weapon release safety system comprises an active state, an inactive state, and a tracking system. When in the inactive state, the weapon release safety system can indicate that a weapon has not been drawn from a storage therefor. When in the active state, the weapon release safety system can indicate that the weapon has been drawn from the storage therefor. The weapon release safety system can be in the inactive state while the weapon is within a proximity of the storage, and the weapon release safety system can be in the active state while the weapon is not within the proximity of the storage. The tracking system can be configured to track a number of times that the weapon has been drawn from the storage by a bearer.

20 Claims, 28 Drawing Sheets

Automatic Beeper Cancellation and Continuous Flash

Wired Connection For Deceleration Detection

Self-Contained Battery Charging Unit and Battery Compartment

Bicycle and Vehicle Remote Brake Activation

Trailer Mode

Instant on Emergency Flashing

SAFETY SYSTEMS AND METHODS

RELATED APPLICATIONS

This application claims the benefit of and priority to U.S. Application No. 62/880,516, filed Jul. 30, 2019, the content of which is hereby incorporated by reference in its entirety.

U.S. Pat. No. 6,529,126, the entire disclosure of which, except for any definitions, disclaimers, disavowals, and inconsistencies, is incorporated herein by reference.

U.S. Pat. No. 6,933,839, the entire disclosure of which, except for any definitions, disclaimers, disavowals, and inconsistencies, is incorporated herein by reference.

TECHNICAL FIELD

This disclosure relates to tracking information indicative of vehicle deceleration or stopping for safety management of a vehicle, an operator of the vehicle, or both.

BACKGROUND

Operation of motor vehicles, such as automobiles, trucks, personal motor vehicles, and motor boats, constantly places motorists at potential risk of property damages, injuries, and even fatalities. Due to the speed and power of motor vehicles, many dangerous situations exist that can result in collisions. For example, operators of personal motor vehicles, such as motorcycles, have inherent safety concerns normally not associated with other vehicles. In addition to the common hazards of minimal collision protection, a danger that is becoming more common with newer motor vehicles is that, even without braking, they can decelerate very rapidly, almost as fast as braking itself. Recent models of motorcycles can decelerate as much as three times as fast as a car. This presents a dangerous situation because the brakes are not used. When braking, a motor vehicle's tail brake light will illuminate to warn following traffic that the motor vehicle is braking. However, if a motor vehicle rapidly decelerates without braking, the brake light will not illuminate to warn others that the motor vehicle is slowing down. Therefore, following traffic is not provided adequate warning of the deceleration. There is a continuing need for safety devices that provide deceleration warning on any vehicle without use of a vehicle's braking system.

SUMMARY

This disclosure makes it clear that an automobile (e.g., all vehicles including military tanks, trucks, airplanes, helicopters, etc.) can signal, without applying the brake, deceleration with its brake lights whether it is factory installed or not and/or with an auxiliary lighting source in any color.

Embodiments disclosed herein can be built into a vehicle with the use of tilt sensors and accelerometers in any combination on any one axis, multiple axes, or all axes (e.g., up, down, sideways, backward, forwards, etc.). Some embodiments can also be built as a stand-alone product as an accessory for any vehicle.

The benefits to such embodiments include any moving vehicle that slows down without using its brakes can show an indication of braking. Embodiments disclosed herein can sense this deceleration, and the normal brake lights on any vehicle can illuminate automatically, providing the warning to others.

Embodiments disclosed herein can also be used on the front of a vehicle. This is useful, for example, at a 4-way stop. This addresses the age-old driving question: Who is moving at a stop sign: them or me? Embodiments disclosed herein can allow motorists to be able to see who it is.

The present disclosure includes a weapon release safety system, in accordance with principles of the present disclosure. The weapon release safety system comprises an active state, an inactive state, and a tracking system. When in the inactive state, the weapon release safety system can indicate that a weapon has not been drawn from a storage therefor. When in the active state, the weapon release safety system can indicate that the weapon has been drawn from the storage therefor. The weapon release safety system can be in the inactive state while the weapon is within a proximity of the storage, and the weapon release safety system can be in the active state while the weapon is not within the proximity of the storage. The tracking system can be configured to track a number of times that the weapon has been drawn from the storage by a bearer (e.g., a user, storage, place, etc.). The weapon release safety system can include a sensor assembly configured to cause the weapon release safety system to move between the inactive state and the active state. The weapon release safety system can remain in the active state so long as the weapon is not within the proximity of the storage.

In embodiments, the sensor assembly can include a first sensor attached to the storage and a second sensor attached to the weapon. The weapon can be a primary weapon or a secondary weapon. The sensor assembly can include a third sensor attached to the other of the primary weapon and the secondary weapon than the second sensor. A frequency at which the second sensor operates can be the same frequency at which the third sensor. The weapon can be a taser, a baton, or a firearm.

A number of safety and/or convenience features are disclosed in the present disclosure. For example, the weapon release safety system can include a safety light configured to alert surroundings of a wearer's presence and to deactivate when the weapon release safety system is in the active state. The weapon release safety system can include a kill switch configured to override the alert of the safety light. The weapon release safety system can be configured to be in operative communication with a server and to enter a maintenance mode in which the weapon release safety system is inhibited from entering the active state when in a proximity of the server and to exit the maintenance mode in which the weapon release safety system is allowed to enter the active state when outside of the proximity of the server. The weapon release safety system can be configured to provide an alert to the server when in the active state. The weapon release safety system can include a GPS for determining a location of the bearer and the alert includes the location of the bearer. The server can include the tracking system, and the tracking system can be configured to track a time at which the weapon was drawn from the storage and a location at which the storage, the weapon, or both were last used.

The present disclosure includes an animal safety system, in accordance with principles of the present disclosure. The animal safety system and include a first unit, a second unit, and a signal. The first unit can be configured to attach to an animal. The second unit can be in operative communication with the first unit and configured to detect a proximity of the first unit to the second unit and to provide commands to the first unit in response thereto. The signal can be in operative communication with the first unit, the second unit, or both and configured to alert surroundings of a presence of the bearer. The animal safety system can include a kill switch configured to override the signal. The signal can include a light with a selectable flash rate such that the light is made to flash solid, rhythmically, or randomly.

In embodiments, the animal safety system can be configured to transmit sound from a user to a bearer. The sound can include inaudible sounds. The sound can include audible sounds. The audible sounds can be transmitted commands of the user to the bearer. The sound can be transmitted via a software application. The software application can be run on a smartphone.

DETAILED DESCRIPTION

Figure 1:
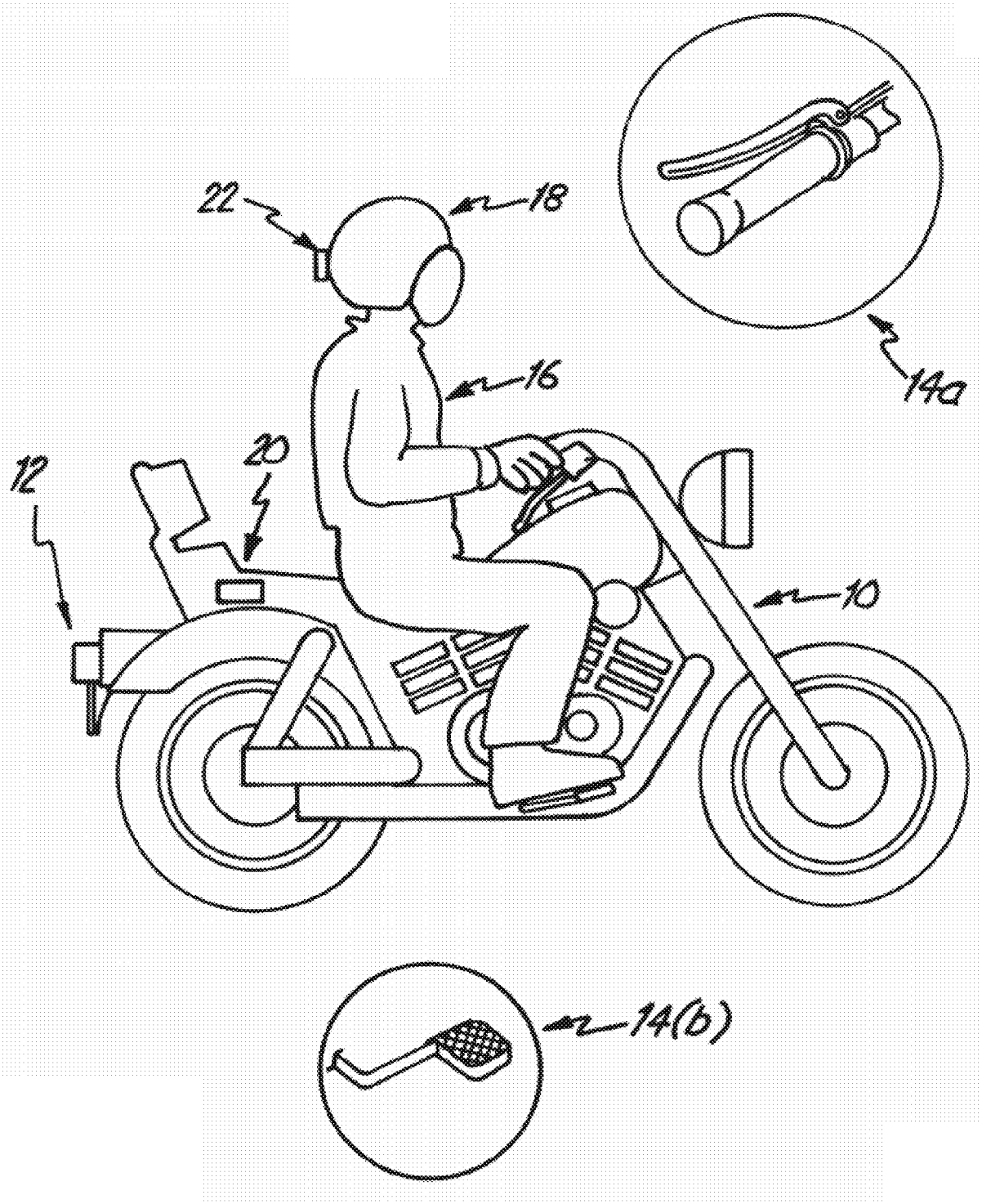
FIG. 1 is an illustration of an illustrative system in use on a motorcycle.
Figure 2:
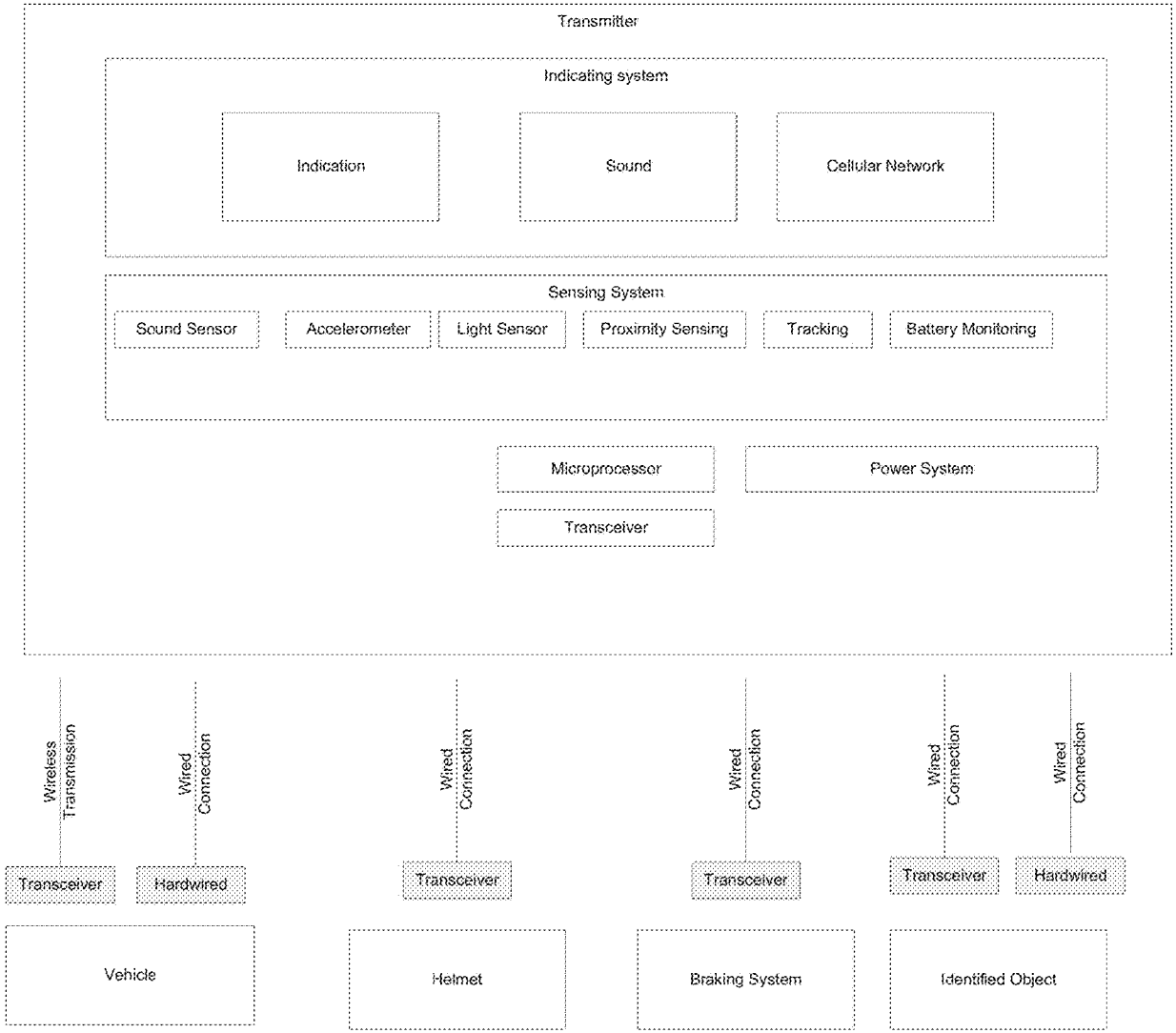
FIG. 2 is a block diagram of an illustrative system.
Figure 3:
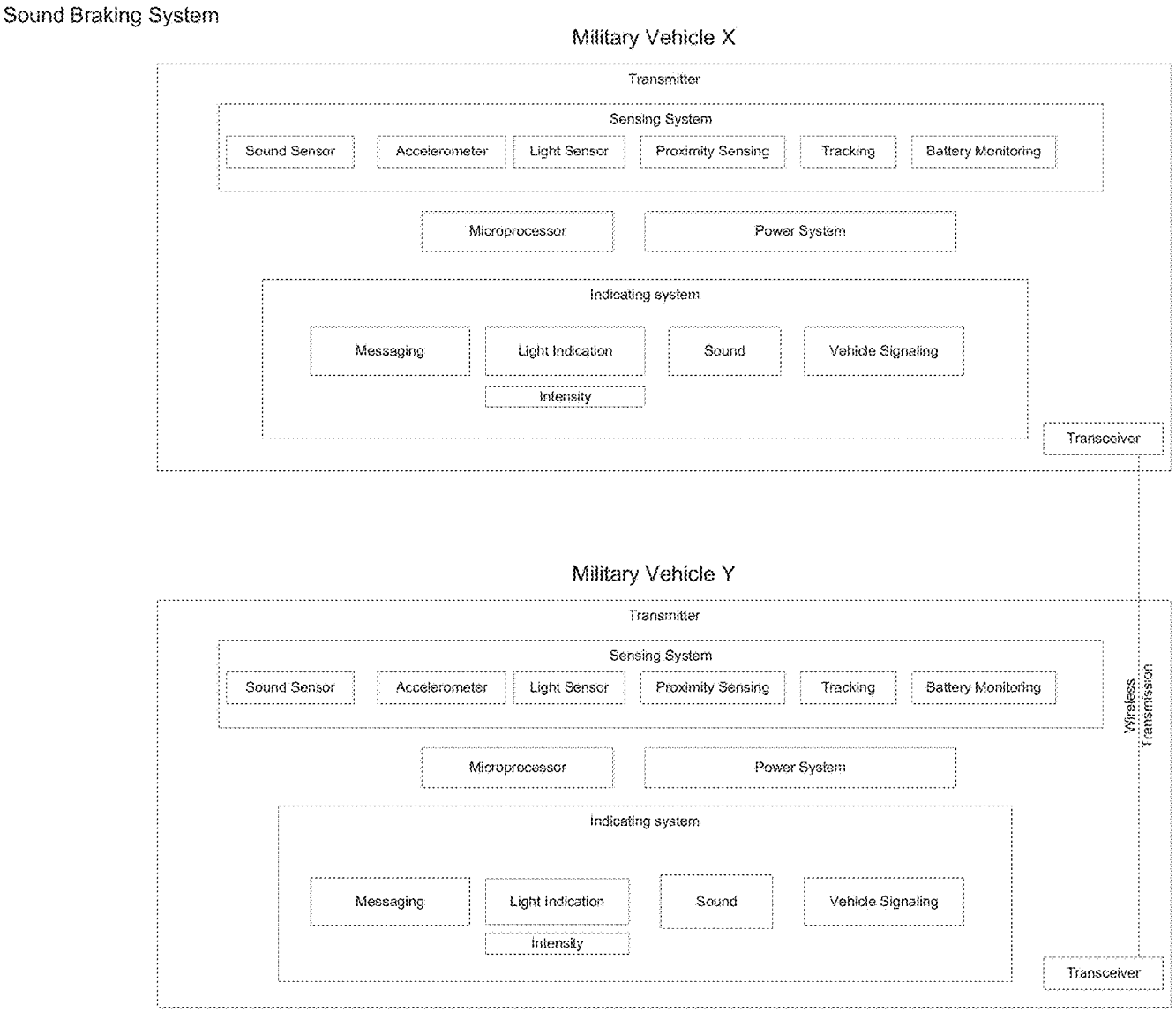
FIG. 3 is a block diagram of an illustrative system with a sound braking system.

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes may be provided for selected elements and all other elements employed known to those of skill in the field of the invention. Those skilled in the art will recognize that many of the examples provided have suitable alternatives or combinations of embodiments that can be utilized.

Systems and methods disclosed herein can be used with wireless transmission, and it can be used independently, without a wireless signal, with a hard-wired installation to any factory brake light system on any vehicle. In general, systems (e.g., detection, sound, light, proximity, and other systems) disclosed herein may use any number of sensors/sensor assemblies (e.g., proximity sensors, light sensors, etc.) and/or communication units (e.g., receivers, transmitters, transceivers, etc.) in operative communication to perform various tasks (e.g., sensing, actuating, signaling, etc.) required for a particular application. Several embodiments can also send a wireless signal (e.g., buzzer, sound, etc.) to the driver, indicating a deceleration brake alert. Some embodiments disclosed herein can have multiple sensitivity settings (e.g., low, medium, high). These settings can determine which deceleration threshold to use to activate the warning.

A wired deceleration detection circuit, which can be used on any vehicle to include cars, trucks, etc., is disclosed herein. This deceleration detection system can be attached to the vehicle's own brake wiring circuit. This deceleration detection system can send a signal via current to activate the brake light on the vehicle during deceleration as long as deceleration is present and/or for a period of time (e.g., using a timer).

A sound braking system can transmit brake indication through sound to another vehicle. Such embodiments can be useful, for example, on military vehicles during nighttime maneuvers in combat convoys or combat convoy training. These types of combat maneuvers can become highly dangerous because almost all military vehicles in combat operate in black-out mode at night (e.g., with no lights). In combat, vehicle movement at night can be conducted with all lights on all vehicles (e.g., head light, brake lights etc.) blacked out, covered, or with the brightness turned down. These measures can conceal the location and movement of military vehicles from the air (or elsewhere) during combat. A low powered sound brake warning system can transmit to one or more vehicles traveling together in convoy, which can prevent these important and highly targeted vehicles from running into one another at high speeds during the night. Given the potential for sudden stops and/or turns, untimely accidents can cause delays for any one or more vehicles in reaching their targets/destination.

Embodiments of the sound brake system may be wireless and/or may include pre-programed left and right turn indications via sound and/or voice turn instructions live or pre-programed (e.g., similar to those discussed in Patent '839). Such systems can include left and right turn signals, back up light and movement detection, etc.

Some embodiments of the sound braking system include the use of a wired deceleration detection circuit. Such brake detection can automatically sense deceleration and can send the corresponding brake indications as outlined above. Some such embodiments may also include wired deceleration detection.

Systems and methods as disclosed herein can have a variety of applications and can include a number of features. Various embodiments can be used in public transportation, city buses, school buses, limousines, etc. Several embodiments can be used with heavy vehicle equipment and extremely oversized equipment. Some embodiments can transmit pre-programmed messages from a selectable database when certain conditions are present. Many embodiments can include automatic night time dimming (e.g., the brighter the day, the brighter the LED lights). Some embodiments include an instant on emergency flasher. Various embodiments can include a brake light built into the local unit 20 when used on bicycles or other non-powered vehicles.

Many embodiments can include automatic beeper cancelation after a pre-determined time period. Similar to embodiments described in U.S. Pat. No. 6,529,126 ("Patent '126"), an improvement to the system can be the addition of a timer. At a predetermined default time, the beeper sound can turn off and the light can continue to flash.

Some embodiments of the beeper cancelation can include continuous flash. As in embodiments similar to those described in Patent '126 and U.S. Pat. No. 6,933,839 ("Patent '839"), continuous flash at a stop light or stop sign can occur without holding the brake pedal on the vehicle. Such embodiments can inhibit rear end collisions at full stop of a vehicle, for example, by flashing and sending signals at a stop position as long as the brake is applied. Traditionally, when traffic comes up from behind, there is no indication that the vehicle is at a stop position at the stop light or stop sign unless the brake is applied. Various embodiments can allow the user to release the brake and can continue to flash the brake lights (e.g., for a predetermined time period or a manual time setting option) without holding the brake pedal or brake lever. Through the use of an accelerometer (or other device) similar to those described in Patent '839, systems and methods disclosed herein can detect the forward movement of the vehicle, and it can default back to normal operation and discontinue the continuous flash feature until the next stop.

Several embodiments of the system can include wired connection for deceleration detection. For example, the function switch (e.g., similar to those described in Patent '126 and Patent '839) can be wired into the vehicle part of that attachment to the brake wire(s) of the vehicle. When the system senses deceleration, an electrical signal/current can be sent to the factory brake system from the function switch (e.g., on local unit 20), activating/illuminating the factory brake on deceleration. When the vehicle's brake is applied, the signal from the function switch can be overridden by the factory brake system, and factory brakes can operate as normal.

Figure 4:
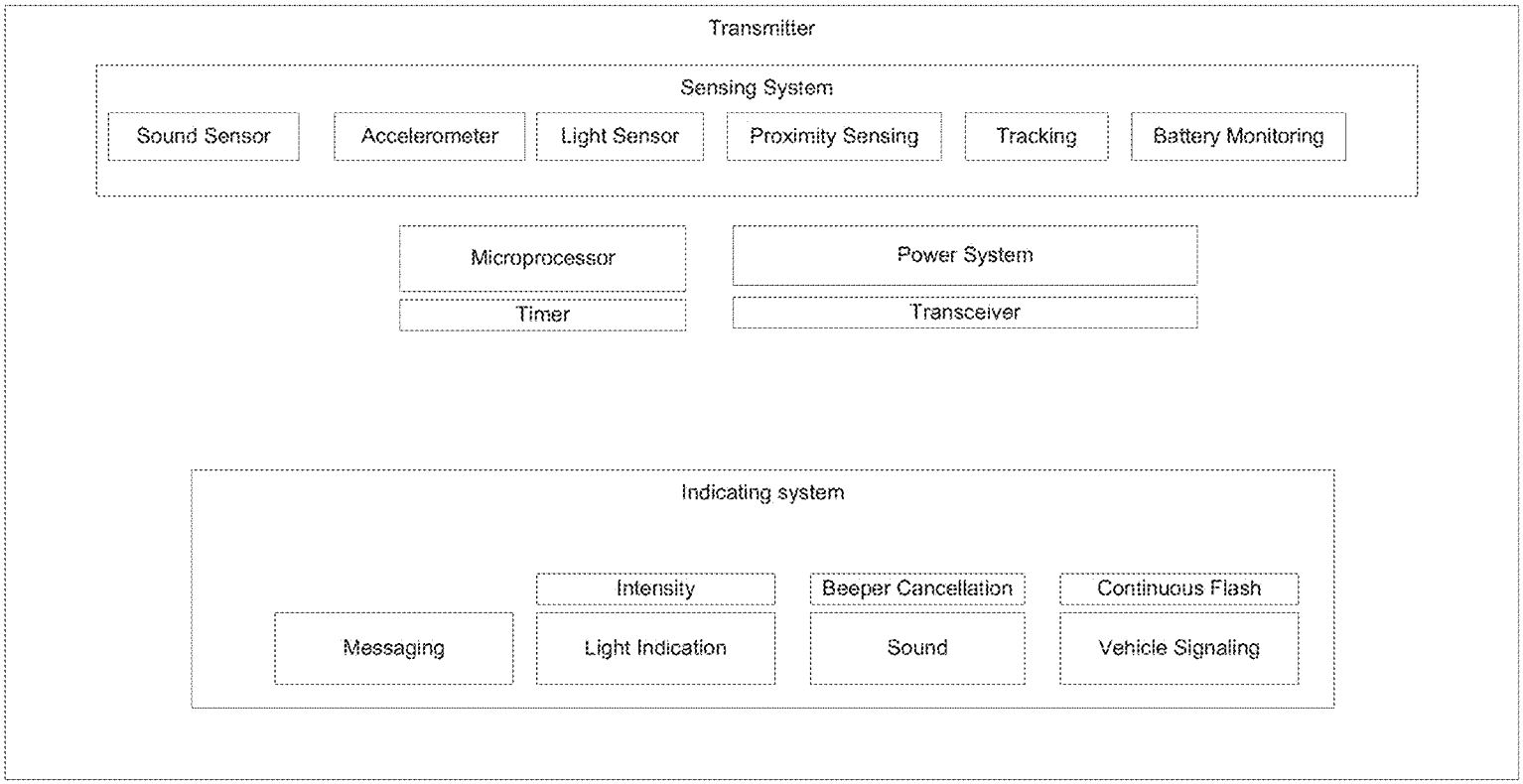
FIG. 4 is a block diagram of an illustrative system with automatic beeper cancellation and continuous flash.
Figure 5:
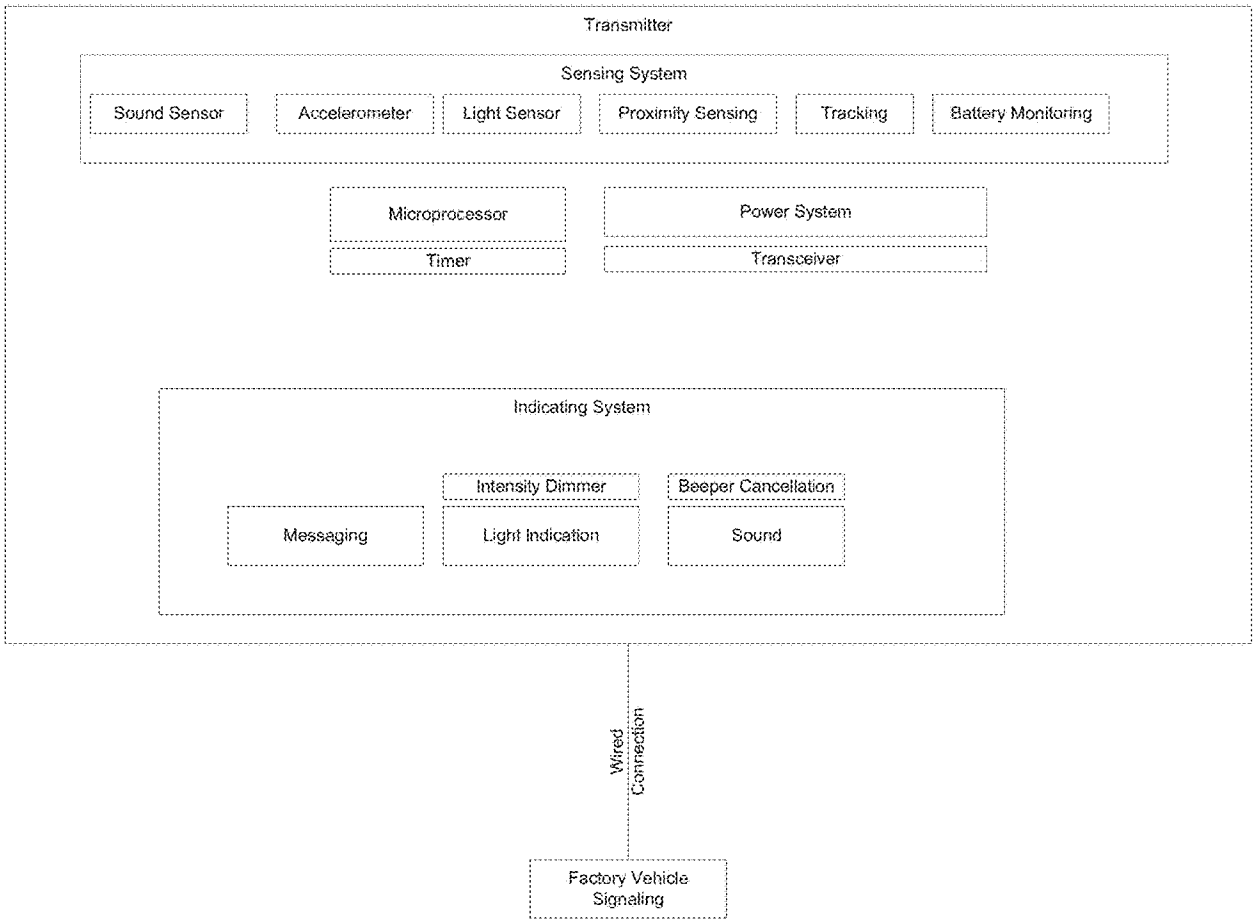
FIG. 5 is a block diagram of an illustrative system with a wired connection for deceleration detection.
Figure 6:
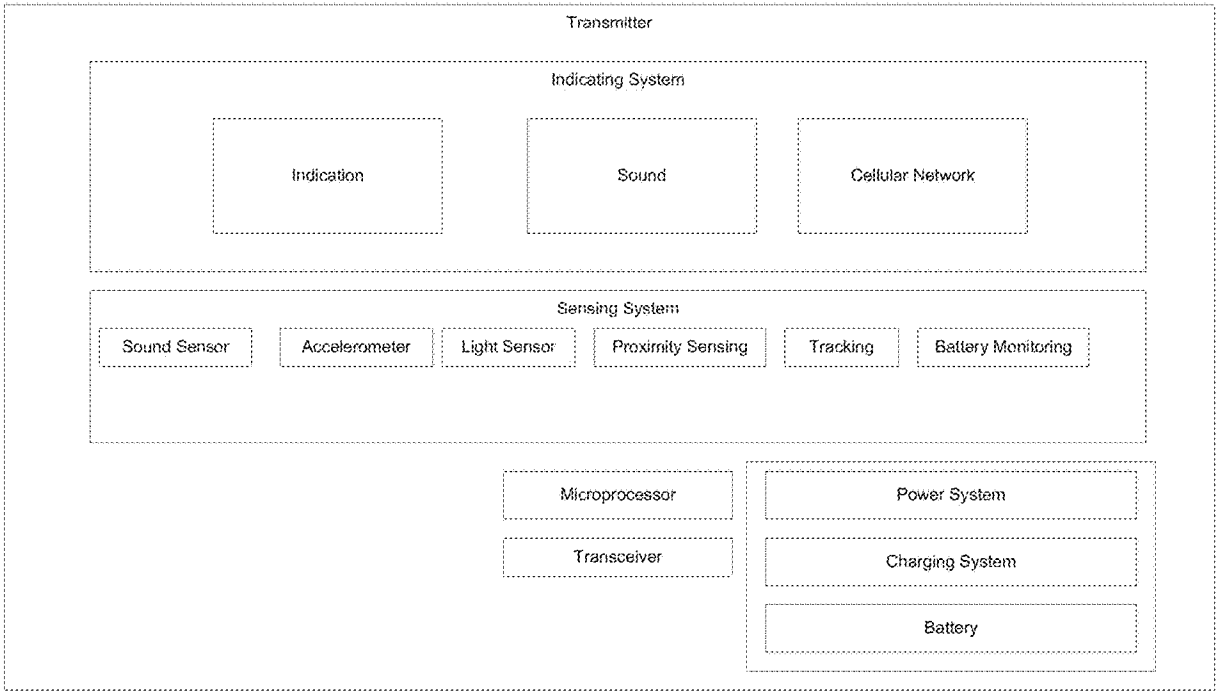
FIG. 6 is a block diagram of an illustrative system with a self-contained battery charging unit and battery compartment.
Figure 7:
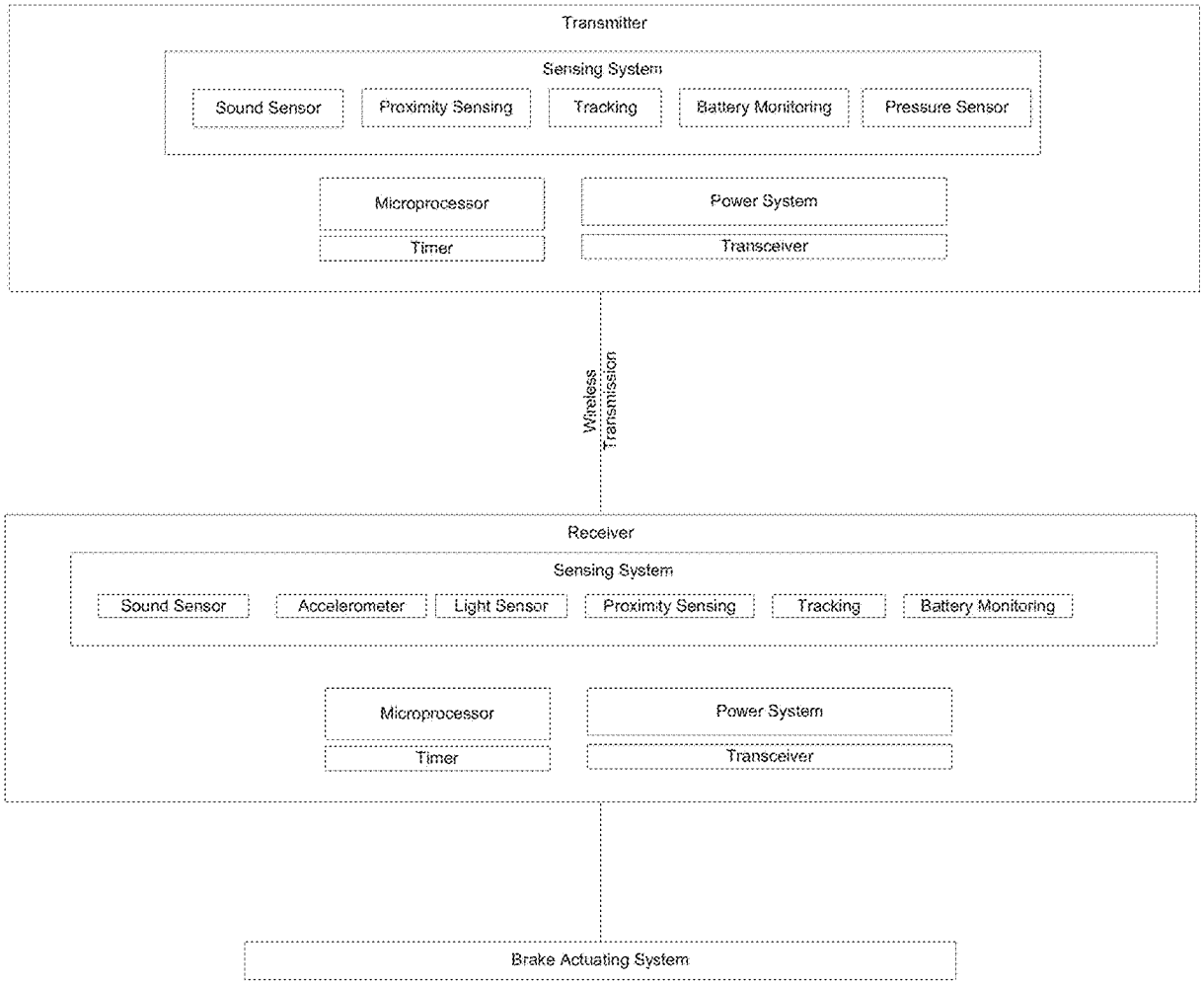
FIG. 7 is a block diagram of an illustrative system with bicycle and/or vehicle remote brake activation.

Embodiments similar to those described in Patent '126 (see, e.g., local unit 20 and FIG. 4 of Patent '126) include a battery charging station independent of local unit 20. Some embodiments disclosed herein can combine the battery charging station 46 into one unit as part of local unit 20. The function switch on this local unit 20 can include multiple positions or other function switches that include other options and that is not limited to a set number of options. This configuration with the battery charging station in local unit 20 can be used with any type of batteries placed in it for power. The batteries can provide an alternate power source to this local unit 20. This feature can be of particular value should the user choose to not hard-wire local unit 20 into the vehicle (referred to as place and go without local unit 20 needing to be wired in the vehicle). Some such embodiments provide the user with an opportunity to experience and/or learn how to use the system first without the need to install any wires to the vehicle. When this local unit 20 is hard-wired to the vehicle, local unit 20 can be detached from the hard-wired assembly via plug, which allows for local unit 20 to be switched from one vehicle to another. In some instances, this feature can be referred to as dual mode and/or battery only mode. This switch-of-power-choice operation can provide a secondary vehicle that may or may not have a wired braking system with the advantages of a third brake light on the helmet or a self-confined remote brake light (e.g., similar to those described in Patent '839 (see, e.g., FIG. 6 of Patent '839)) on the vehicle itself, should it need one.

Some embodiments (including features similar to local unit 20 of Patent '126 and Patent '839) can be used to send a wireless signal to activate a brake on a child's bicycle or other vehicles. Local unit 20, however, in this configuration may not preclude the possibly of it being a self-contained system of itself when operated as a possible hand-held battery powered remote. This configuration of local unit 20 can still provide a wireless signal for the brake light warning as with its deceleration detection. This local unit 20, when used as remote device, may have a compression switch or dial that can determine how much stopping force to apply to the wheels) on a bicycle. The button, when pressed, can send a wireless signal to an actuator or other device, which in turn can apply the corresponding pressure to the brake. How much pressure is used can be controlled by the operator. For example, how hard the switch is turned or button is pressed can correspond to how hard the brakes are applied to the vehicle.

Many embodiments disclosed herein (e.g., embodiments including battery charging station independent of local unit 20) can be used in the hard-wired configuration on other vehicles.

Embodiment of the present disclosure can include a home tracking feature, which can guide selected vehicles back to the remote itself independent of a rider. For example, this feature may be used on Segway-type vehicles or others in the police service when an officer quickly leaves the vehicle without turning it off. If running and equipped with a remote wireless brake light (e.g., similar to those described in Patent '839 (see, e.g., FIG. 6 of Patent '839)) on the vehicle and a wireless brake on a helmet or other location on the user (e.g., similar to those described in the Patent '839), the local unit 20 and local unit 22 can sense the other's location (e.g., similar to those described in patent '126). Like the other features in this disclosure, this proximity detection feature can be used in any other embodiment disclosed herein. This proximity detection can sense both ways and can allow for self-guiding technology of vehicles toward each other (e.g., using a transceiver similar to local unit 20 and a receiver similar to local unit 22).

Some embodiments can include trailer mode. In many embodiments, this feature in can use the factory brake when the vehicle is being carried/towed on a trailer. In some instances, the brake lights on most trailers are very low and hard to be seen. This feature can be used, for example, when a snowmobile or any vehicle (e.g., motorcycles with brake light 12 (as seen in FIG. 1 of Patent '126 and '839), cars, etc.) is being carried on an open trailer to another location. Given that the towed vehicle is now sitting higher when placed on a trailer, it provides the opportunity to use its factory brake light as the elevated early bake warning system for the trailer. In such embodiments, local unit 20 can temporarily replace the need for local unit 22 since it is being carried on a trailer, not ridden or driven in use of this trailer mode configuration. Local unit 20 can be hard-wired into the towed vehicle (e.g., snowmobile, motorcycle, etc.) but may not be wired to any wiring of the trailer itself. Local unit 20 can utilize the factory battery on the vehicle being carried/towed. It can use one or more self-contained batteries in local unit 20 to provide the power necessary to flash the factory brake lights) of the snowmobile, motorcycle (or other vehicles using this feature) through the use of the deceleration detection in local unit 20. As a result of this higher position of the vehicle carried on the trailer, the carried/towed vehicles brake light may be an elevated advance brake light warning for the trailer.

In some embodiments, local unit 20 (e.g., similar to those of Patent '126 and Patent '839) can be configured to activate the factory left and right turn signals without the use of a transmitted wireless signal. In such embodiments, local unit 20 can be hard-wired to the vehicle.

Many embodiments can monitor factory battery levels. Local unit 20, when in trailer mode (also referred to as dual mode), can sense the factory battery power levels and can be designed to shut local unit 20 off if the battery drops to or below a predetermined voltage level. This feature can prevent the amount of power drained from the factory battery. This feature can ensure that, when using the trailer mode feature, the user does not reach a destination and have a dead battery caused by local unit 20. For example, when trailer/dual mode is activated, local unit 20 can automatically sense the power level of said vehicle battery. Whatever that reading is, local unit 20 can consider that to be the starting point or full power. When and/or if the battery voltage reading drops to 50 percent (or lower) of the start reading, local unit 20 can turn itself off.

Various embodiments (e.g., similar to those described in Patent '126 and Patent '839) can include a wired switch/remote. Local unit 20 (Transmitter/TX) and local unit 22 (Receiver/RX) can be turned on and off individually. For example, some embodiments can allow either local unit 20 or local unit 22 to be turned on or off by a remote transmission by the other or an independent remote button/switch designed specifically to turn either local unit on or off by wireless transmission. This switch can be hard wired for power from the vehicle it is used on, and can be set by default to send the corresponding signal to either TX unit or both TX and RX at the same time. Here is an example of how it can work (although it is not in any way limited to this example): The remote switch can be pressed once, which turns the light (e.g., local unit 22) off or on. If the remote is pressed twice in rapid succession, it can turn only the Transmitter (TX) on or off. Turning the TX off automatically can send the light (e.g., local unit 22/RX) into emergency flashing mode as a result of not receiving a bounce back signal from the TX, indicating it is still active/on. This feature can inhibit the need to manually turn the system on or off in an emergency or in other situations when needed. The need for this feature can become clear in normal use of the device but is of value in use where there is a need for stealth operations (e.g., law enforcement officers and/or military).

Many embodiments (e.g., similar to those disclosed in Patent '126 and Patent '839) can include a wireless switch/remote. In such embodiments, the remote switch can be wireless from any power dependency on the vehicles. It can use only batteries. Such embodiments can be wired, receiving its power from the vehicle it is used on. Some embodiments can use wireless transmission to send their individual signals to the TX and RX units. However, neither the wired nor wireless embodiments disclosed herein are in any way limited to the scope of this example.

Some embodiments can include a short range proximity feature. Similar to Patent '126 and Patent '839, the proximity feature in these embodiments can be activated automatically by a distance separation between the local unit 20 and local unit 22 (of approximately 6 to 15 feet from one another). In embodiments disclosed herein, through the use of the remote switch (e.g., wired or wireless), when the remote switch is placed in a specific mode, the distance separation can be reduced to as close to zero as possible.

Various embodiments can include instant on emergency flashing feature. In some such embodiments disclosed herein, the emergency flashing mode system can require the ignition to be turned off in the vehicle to activate the instant on emergency flashing feature of the system. The loss of signal to the RX from the TX can trigger the light (e.g., local unit 22) activation. The TX can be hard wired to the vehicle power (e.g., using any wire that is live when ignition is turned on) for this to work. This feature can be used for traffic control safety with police, military, funeral procession, parades, etc. In all these embodiments, the rider/user of a motorcycle, bicycle or other vehicle can be on and off or in and out of the vehicle at an intersection. The instant-on-emergency-flashing feature disclosed herein can inhibit the need for a user to turn the vehicle's ignition switch off each time to activate the instant-on-emergency-flashing system or step outside the stated range to activate the proximity feature of the system. Because the user seldom, if ever, turns his/her vehicle off or seldom steps outside the proximity range (e.g., 6-15 feet) in normal use, traditional emergency flash features are seldom used in this setting. The embodiments disclosed herein can make this feature automatic and can thereby provide the safety intended for the user in all relevant settings and situations of this kind. For example, the remote switch in such embodiments can also benefit even if the system is operated in Battery Only Mode embodiments of this application. The example used here does not in any way limit the scope of this feature.

Many embodiments can include light sensing transmission: automatic dimming/night time dimming. The LEDs (or other light emitting sources) on the local unit 22 can have a photo sensor that detects any light. This feature can determine how bright the light source is. Local unit 22 can turn the brightness of its LEDs down or up to a preset brightness or a controllable brightness value set. This feature can allow LED brightness on local unit 22 to change brightness automatically in bright daylight and in the dim light at night. In other words, the brighter the day, the brighter the LEDs on local unit 22 can be. As the brightness of the light source goes down, the LEDs in local unit 22 can reduce their brightness. Other benefits can include: extending battery life because the lower levels of LEDs can require less power, and reducing the risk that other drivers can be distracted by an overly bright light, particularly at night.

Auto-dimming in some embodiments may not limited to just brake lights on the local unit 22, but can include turn signal lighting and other lights on a vehicle or a remote light (e.g., similar to the lights described in Patent '839 (see, e.g., FIG. 6 and local unit 80 of Patent '839)). Embodiments of local unit 80 disclosed herein can have left and right, turn signals that will use the increases or decreases of light levels from an outside source.

Various embodiments can include auto adjustment levels of the dimming feature. For example, if the brake light LEDs (or other lights controlled by the system) are at their lowest levels of brightness, the dimming feature can have an automatic full brightness detection. This feature can turn the LEDs to full brightness when it detects a brighter light source behind it, as with a vehicle coming up from behind. Such embodiments can sense the light source and turn to maximum brightness instantly. When that bright light source is gone, such embodiments can default back to the appropriate setting for its surrounding light source.

Some embodiments disclosed herein (e.g., similar to those of Patent '126 and Patent '839) can be advantageously used for police, state patrol and the like. Many embodiments disclosed herein can reduce the risk of a potential safety concern that police officers in the line of duty may face using traditional systems. For example, (e.g., as discussed in Patent '126 and Patent '839) when local unit 20 is connected to the wiring of a vehicle, it transmits a wireless signal to local unit 22 on activation of the brakes or deceleration. If, for example, an officer is using this system on a motorcycle and leaves the bike to approach an individual in a car vehicle that has been pulled over or is in need of help, embodiments disclosed herein can be designed with a proximity system built into them to ensure a positive wireless connection between the TX local unit 20 and RX local unit 22. This proximity system can sense that the user 22 is away from their vehicle with the transmitter TX 20. When a certain distance is reached (e.g., the distance between local unit 20 and local unit 22), such embodiments can be designed to begin flashing the light on the helmet or other physical location (e.g., local unit 22), providing a visual location of the user for protection on a freeway. This feature, for example, can be advantageous because oncoming traffic can easily lose sight of the rider/driver who is away from their vehicle in the midst of police lights, head lights, and so on.

This feature can add a significant safety benefit to anyone using the system. However, for example, in the case of police officers, there could be a situation where this automatic proximity lighting may become a safety detriment. As such, some embodiments disclosed herein can include a system kill switch, which can be a wired kill switch and/or a wireless transmission switch that transmits a signal to shut down/turn off to the proximity light (e.g., local unit 22). When the off/shut down signal is detected, it can not only turn off the light but can also override the proximity system and turn off (e.g., local unit 22 and any other selected feature(s) of the whole system via selectable mode choices).

Another safety feature to the proximity system can be weapons release. If the situation requires an officer to draw his or her service weapon for any reason, removal of a weapon from a storage (e.g., a holster, a case, a safe, a gun belt, a tactical belt, etc.) can activate a default setting to automatically shut down (e.g., switch off) the entire system. In this situation, no light may be on that could pose a risk to the officer by inadvertently giving away their visual position or location. If this weapons release default has been activated, it can remain in that setting until it is turned off (e.g., by wired switch, wireless transmission, or adjustable timer expiration).

Another safety feature in some embodiments can be a self-activated alert system for an officer. In this embodiment, the use of GPS mapping location (e.g., should an officer's service weapon be drawn from its holster or other location) can automatically activate an uplink emergency message to their precinct, or other destination, that their weapon has been drawn and to send back-up to that location. This feature can be useful if a downed officer or others are unable to call for assistance. This feature can have many other potential uses and options, as well as military use.

Another safety feature of weapons release can be for the general public. As stated above, when a weapon is drawn from its holster, the system can uplink an emergency message to their precinct notifying them that the weapon has been drawn. Features of some embodiments disclosed herein can be used independently of all other features such as an automatic tracking of whose weapon has been drawn. This information can be used and filed to track when weapons have unnecessarily been drawn and by whom. This feature can improve public safety, for example, in the case of rouge police officers who, without cause, use their weapons/Tasers to intimidate any law-abiding citizen. This measure of tracking can provide an absolute pattern of behavior for an officer, which can offer a preventive measure of safety for the general public should that officer need to be removed from service (e.g., military service and any service involving a weapon of any kind).

Many embodiments of the proximity system (e.g., similar to those of Patent '126 and Patent '839) system can be used with hunting dogs, as well as police K9 dogs. In these cases, a wireless light can be placed on a dog to provide the hunter or officer with a visual location of the dog when needed or at all times if selected. The system can have both a transmitter (TX) and a receiver (RX). The remote (TX) used can have a function switch that allows the user to select different modes. In some modes, when the dog leaves the side of the hunter or officer, the light can come on (e.g., similar to those discussed in Patent '126 and Patent '839). In embodiments disclosed herein, the light pattern can be selectable as opposed to a steady rhythmical flash. In the case of K9 dogs used in police work, this feature can pose an issue with the K9 becoming an easy target. A rhythmical or random pattern of flash can make it difficult to target when it is moving. However, the function switch could allow for a stealth mode. In this case, the light may not be activated automatically by separation of the TX and RX but can be activated manually (e.g., turned on and off) by remote. In this mode, the K9 (or other animals) can move about without being seen. This system can be useful in police work but offers the same unique advantages for hunting dogs as well.

Some embodiments can include the transmission of sound or voice features (e.g., similar to those described in Patent '839). In such embodiments, the TX can carry a small (but may be medium, large, etc., in some instances) speaker that will allow the K9 or others to respond to voice commands (e.g., as trained). Some such embodiments, given the distances that could occur between the K9 and the operator/officer, can maintain a level of control without necessarily being next to the K9. In the use of police work, there can be a risk to the general public of a K9 attacking someone and doing serious harm while waiting on a command to release. This embodiment can offset the risk of legal action to the police department and all law enforcement agencies and, of particular note, the military. This embodiment, given the advances in technology, may be used with an application synced to a phone app or other devices with its software.

Embodiments of the proximity system can enhance child safety. The proximity system (e.g., similar to those described in Patent '126 and Patent '839) for K9 use can be activated by the separation of the TX and RX but is not limited to that. In the use of child safety, given the concerns over lost or kidnapped children, the proximity system can keep children safe by including some of the same features listed above with respect to other embodiments along with the ability to manually set the distance between the guardian (TX) and the child (RX). In the event that a child steps outside a range set by the guardian, the TX can began to vibrate (e.g., similar to a pager). However, in this usage, the guardian (TX) can hear/receive the surrounding sound of the missing child. Safety and time can be of the essence when a child is missing, and being able to hear the sound around a missing child can help in locating and identifying where the child is quickly. The RX can be worn/disguised as a bracelet, a watch, or other accessory/item. The RX can also vibrate if selected and/or flash a light/LED with multiple color choices (e,g., amber, red green etc.) to help aide in a search. Given that this device can be made in any size and with any selectable features, the uses for this proximity feature are many.

As to all the embodiments discussed herein (and in Patent '126 and Patent '839), each embodiment together as a whole or separately can be used to make toy versions of it and/or together with other toys. For example, embodiments disclosed herein can include a toy version of a motorcycle with a toy rider using the safety helmet system similar to those discussed in Patent '126 or Patent '839 and all potential embodiments in this current disclosure.

Some embodiments of the proximity technology can be in the use of travel luggage. Embodiments disclosed herein can be used, for example, in luggage claiming at the airport or other travel points and destinations. Such embodiments can allow the user to quickly identify their luggage with the use of this proximity feature. This embodiment can allow the user to set a programmable light that comes on as their luggage gets closer. This feature can be turned on/off by wireless remote. The light (e.g., RX), which is on the luggage (or built into it), can have a sleep mode feature that turns itself off after a lack of activity (e.g., in programmable time periods).

As described in Patent '839, such embodiments can send signals that are audible. This feature can allow the system to use pre-programmable messages on command. A name or a changeable vocal code which can be heard more than one way, for example on your remote, smartphone or other. This proximity luggage system can sense the other in both directions (e.g., TX and RX) and can wake up by itself when in a selectable proximity range of the other. Even while in sleep mode, the TX can wake the RX up remotely by sending a wireless activation code. This code alert can be used with, but not limited to, smart phones for current status of the system at all times. This can be important on a plane when the familiar request "turn off all devices until we reach a certain altitude" is heard. This feature can provide the security of knowing the status of the system and/or can be a last check of the proximity luggage system before putting away cell phones or setting them to airplane mode. While the current embodiments refer to luggage, it can be designed and employed in any number of items.

Some embodiments (e.g., similar to those of Patent '126 and Patent '839) can use the wireless/wired signals to activate brake light and other lights. Such embodiments can be used in golf and other sports but is not limited to any particular area of sports. These embodiments can help prevent golfers from losing their golf clubs. Through the use of the proximity technology outlined in this disclosure (and, e.g., similar to Patent '126 and Patent '839 (see FIG. 1 and local unit 22), a light can receive a wireless transmission from a transmitter local unit 20. Given that this light can be placed in any configuration, it can be placed in or on the end of the shaft of a golf club handle (e.g., RX).

The TX can be placed in a variety of locations. For the purpose of this example, the TX can be in a remote design and can be placed on the user or the golf bag itself to inhibit lost clubs on the course. Some embodiments can use the proximity system to detect when a golfer leaves their club on the course. Often when a golfer hits a great shot onto the green, in the excitement of the moment, he/she may carry the club just used with them, lay it down, and begin the putting process, forgetting to pick up the club they laid down earlier. In this scenario, the golfer can get to the golf cart and drive to the next tee box/hole while never thinking about the club until they need it during the next round. The embodiments disclosed herein can place a light and beeper in the head of the shaft of any club. When the system is turned on, it can monitor the location and distance of the TX as in local unit 20 and local unit 22 RX (e.g., inside the club).

This system can beep and flash a light on the club itself until turned off or until it comes back within range of the other. The system can, when and if selected, vibrate on the remote with selectable mode for silent or other but not limited in these options. Some embodiments include a theft deterrent system that prevents the sound or light from being turned off by someone who may want to keep, for example, a high-end golf club. This feature can have other security systems in it without departing from the scope or intent of the invention.

Figure 8:
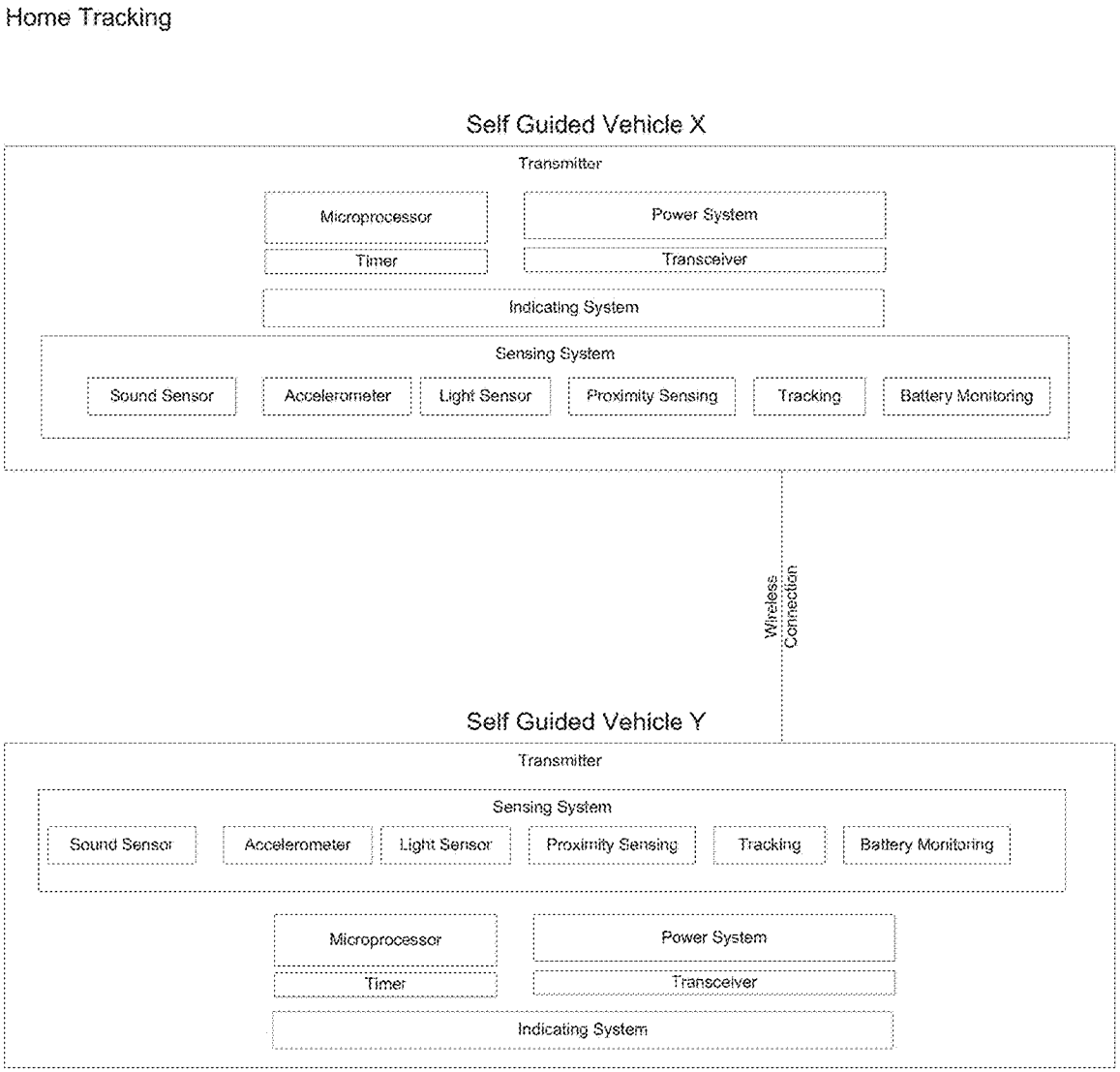
FIG. 8 is a block diagram of an illustrative system with home tracking.
Figure 9:
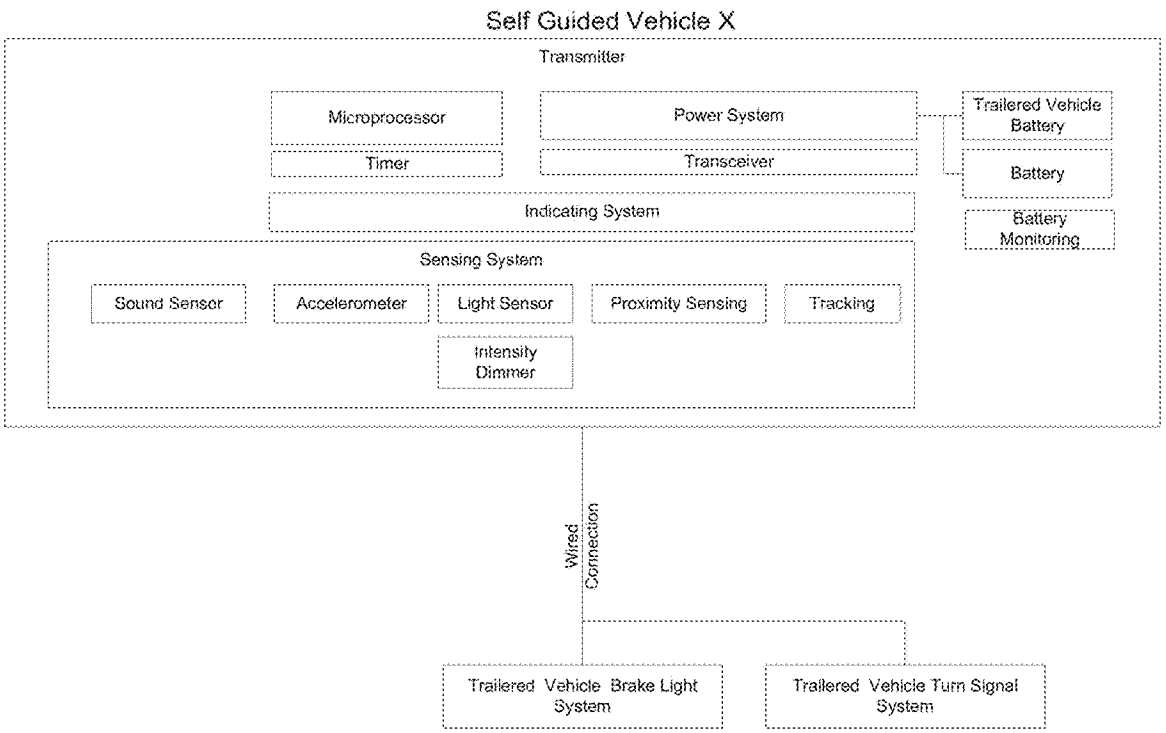
FIG. 9 is a block diagram of an illustrative system with trailer mode.
Figure 10:
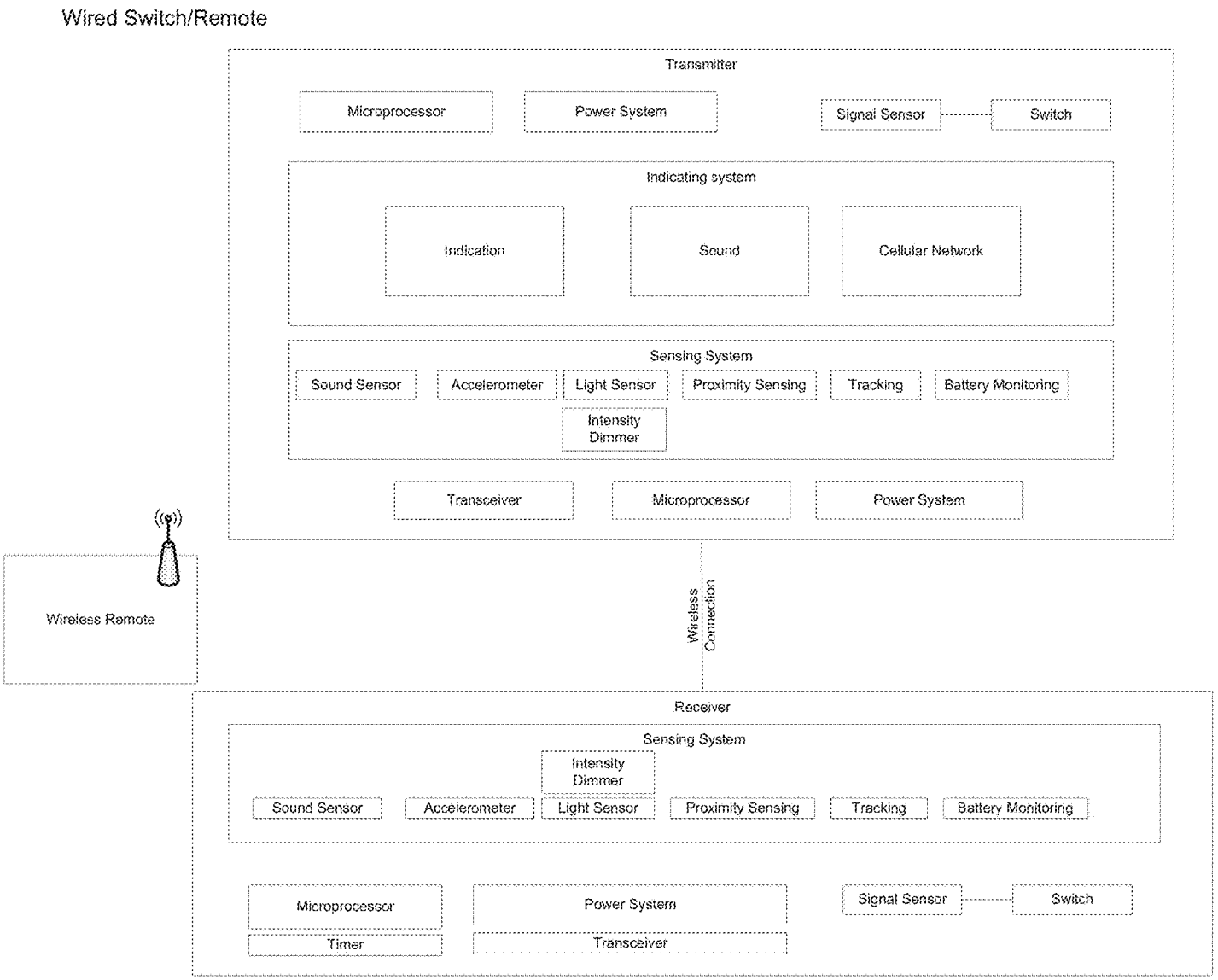
FIG. 10 is a block diagram of an illustrative system with a wired switch/remote.
Figure 11:
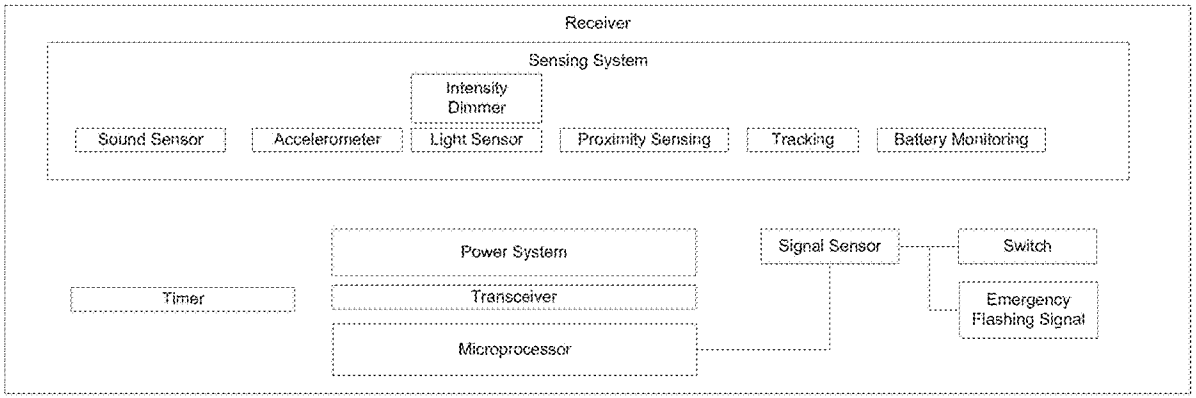
FIG. 11 is a block diagram of an illustrative system with instant on emergency flashing.
Figure 12:
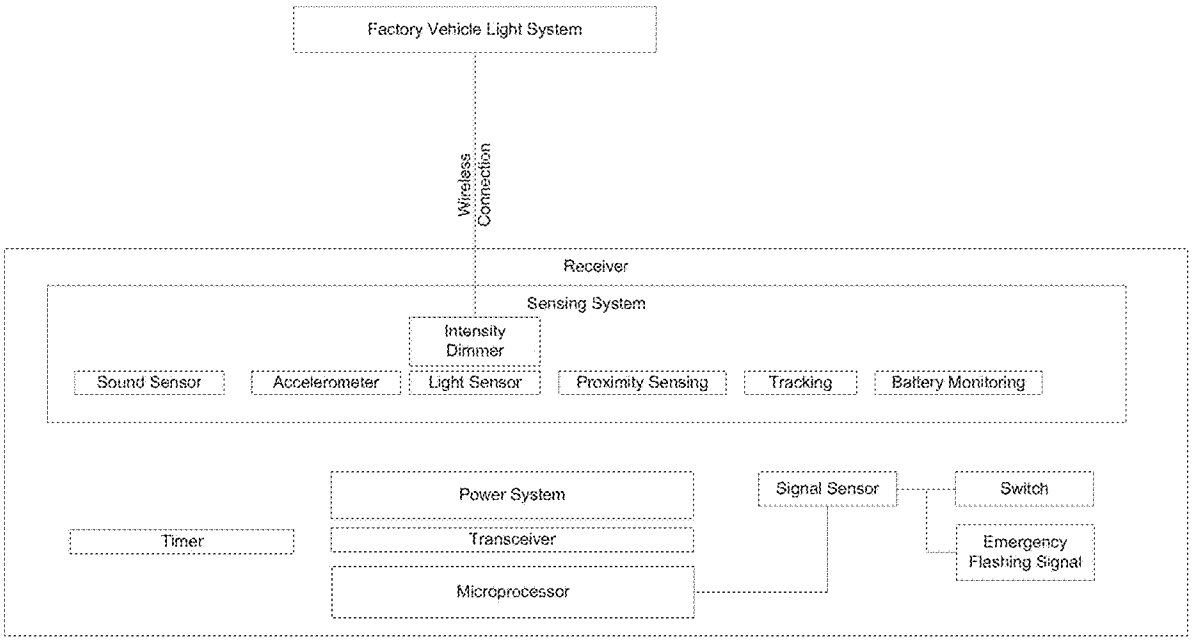
FIG. 12 is a block diagram of an illustrative system with auto dimming/night dimming.
Figure 13:
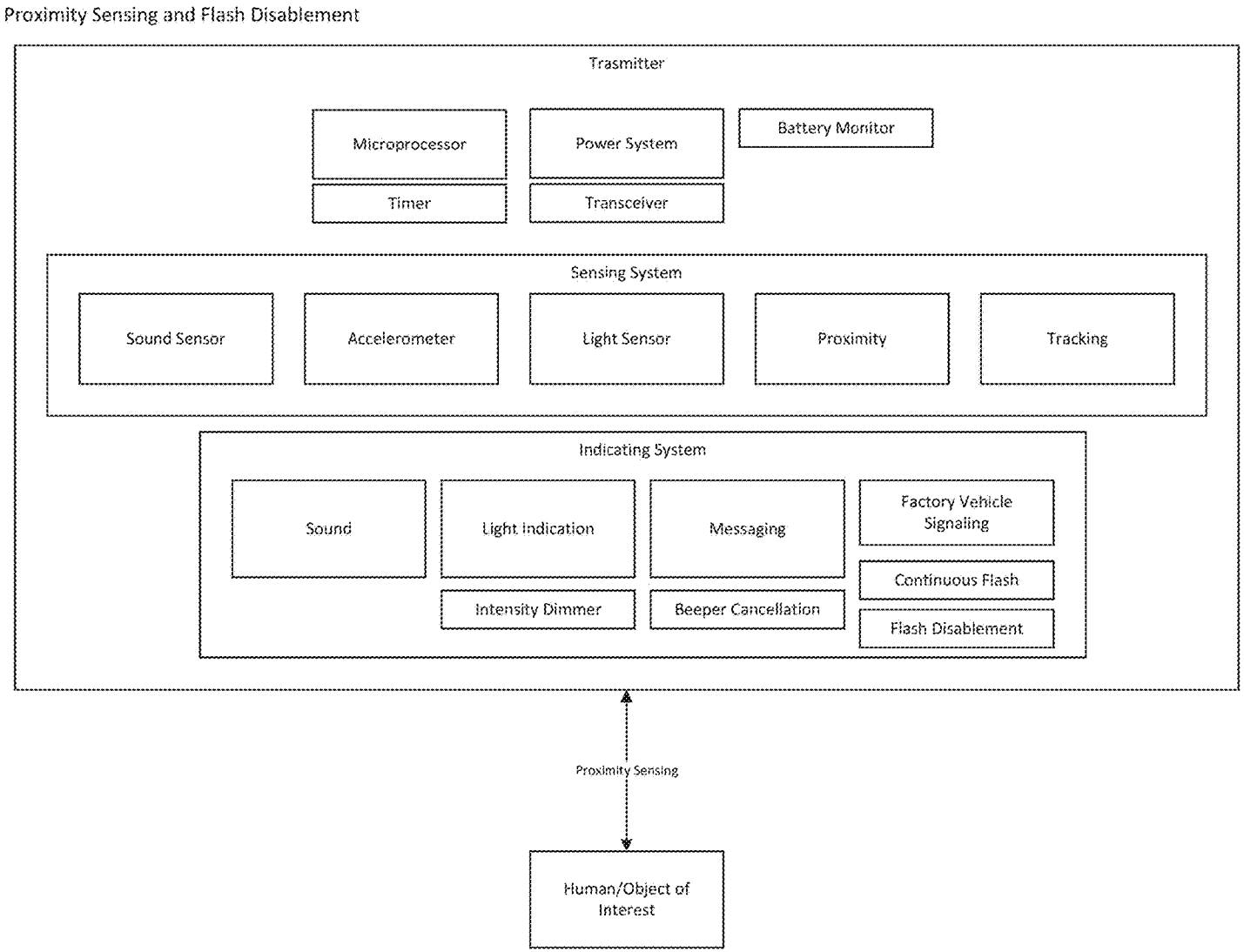
FIG. 13 is a block diagram of an illustrative system with proximity sensing and flash disablement.
Figure 14:
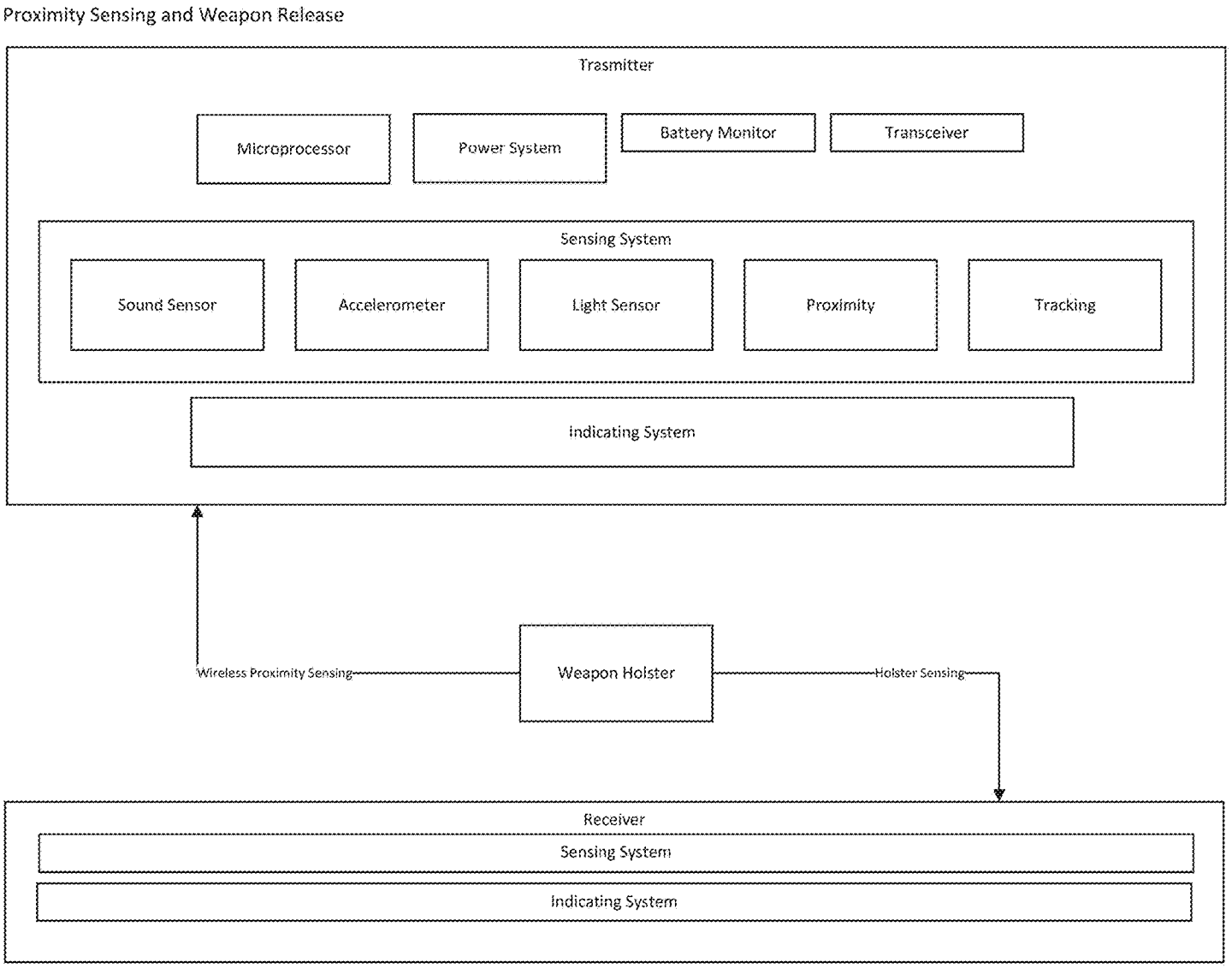
FIG. 14 is a block diagram of an illustrative system with proximity sensing and weapon release.
Figure 15:
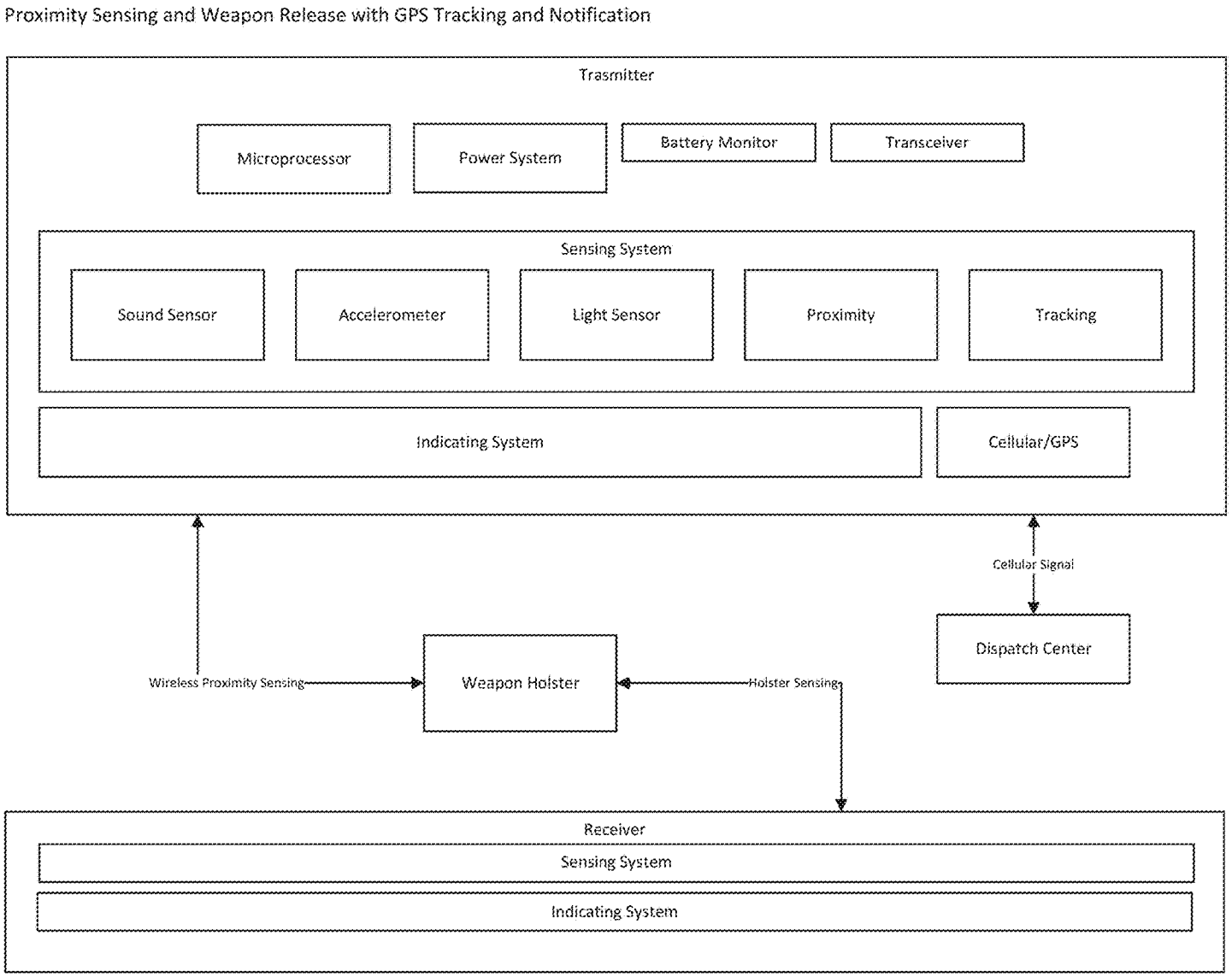
FIG. 15 is a block diagram of an illustrative system with proximity sensing and weapon release with GPS tracking and notification.
Figure 16:
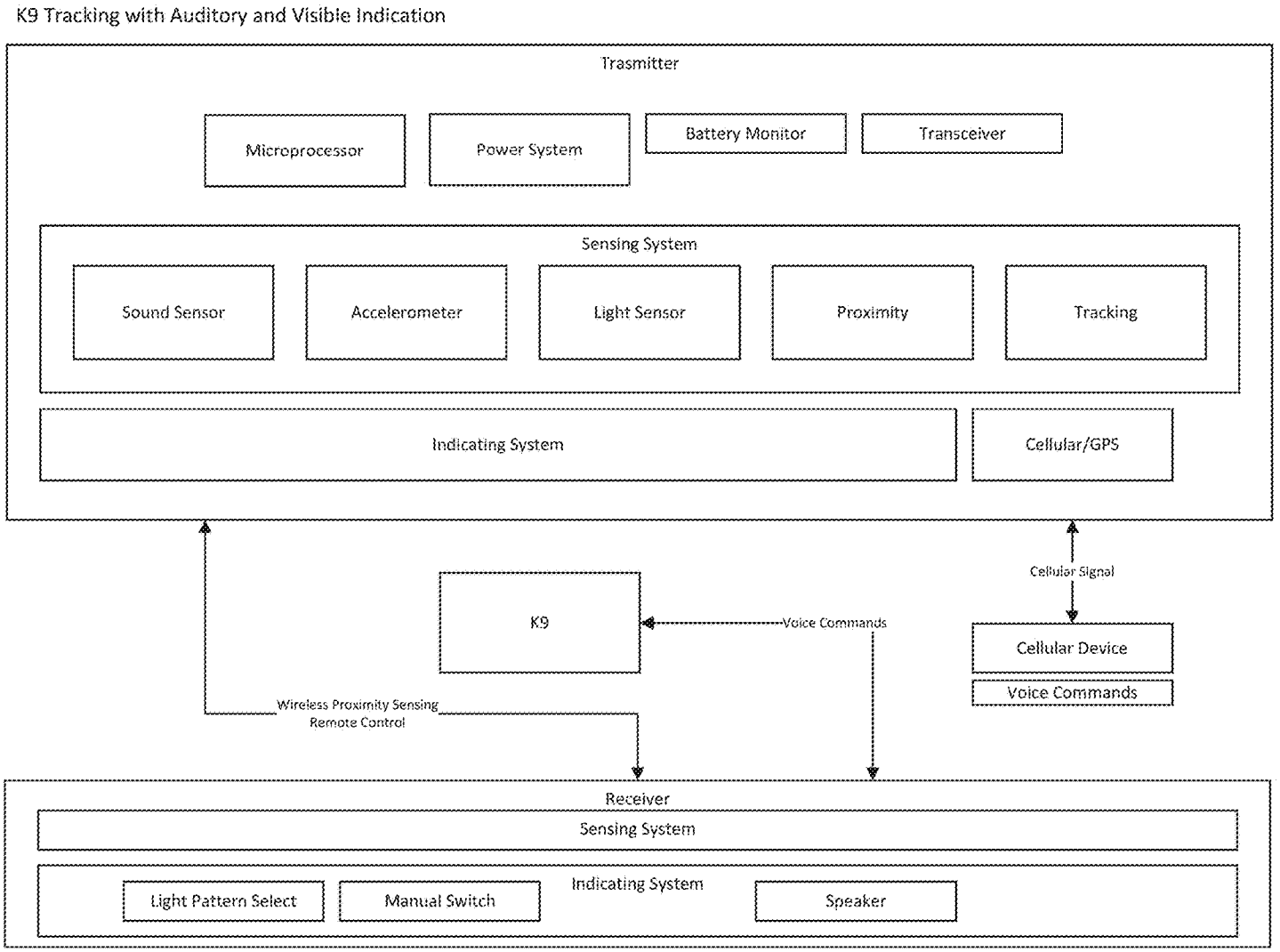
FIG. 16 is a block diagram of an illustrative system having K9 tracking with auditory and visible indication.
Figure 17:
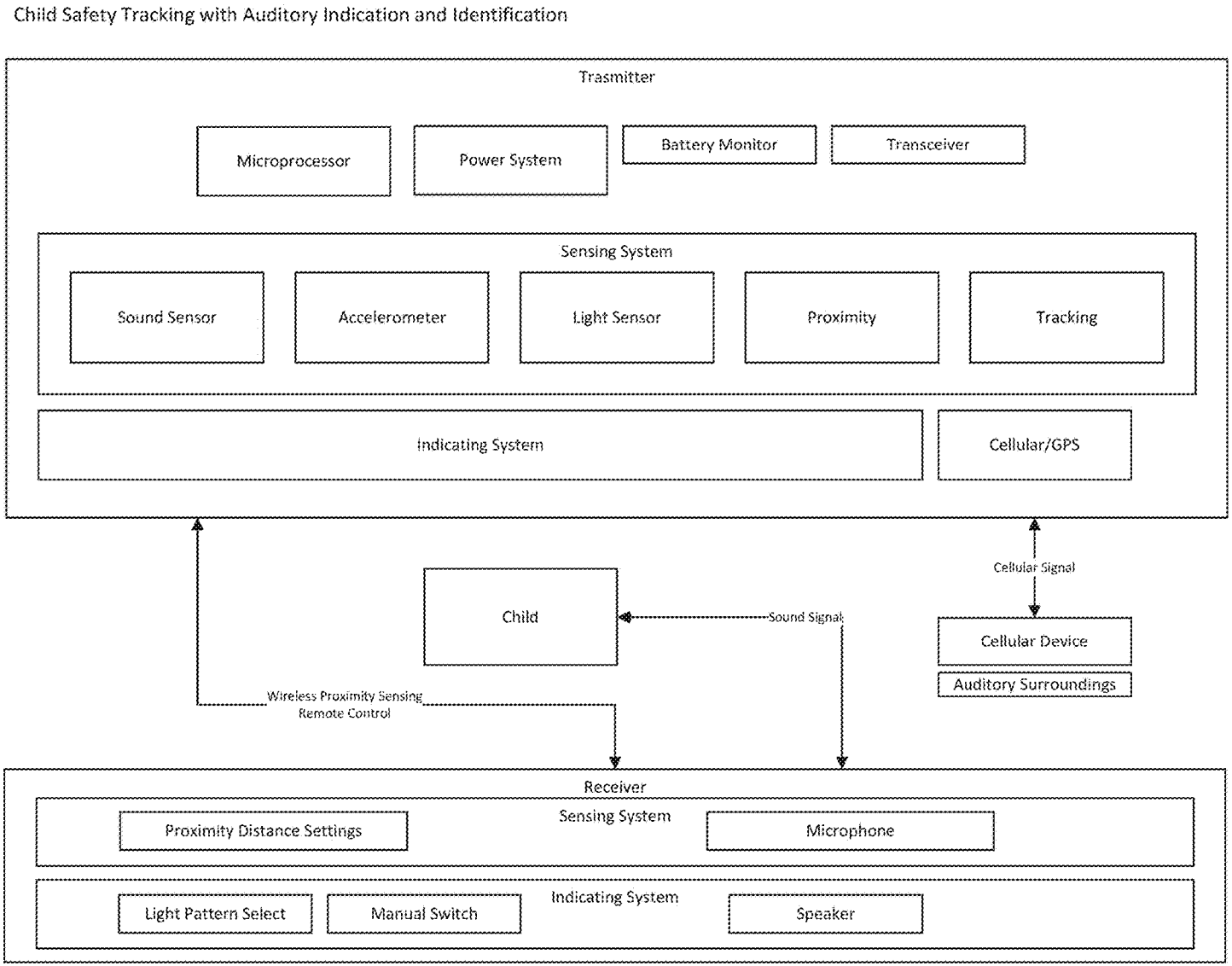
FIG. 17 is a block diagram of an illustrative system having child safety tracking with auditory indication and identification.
Figure 18:
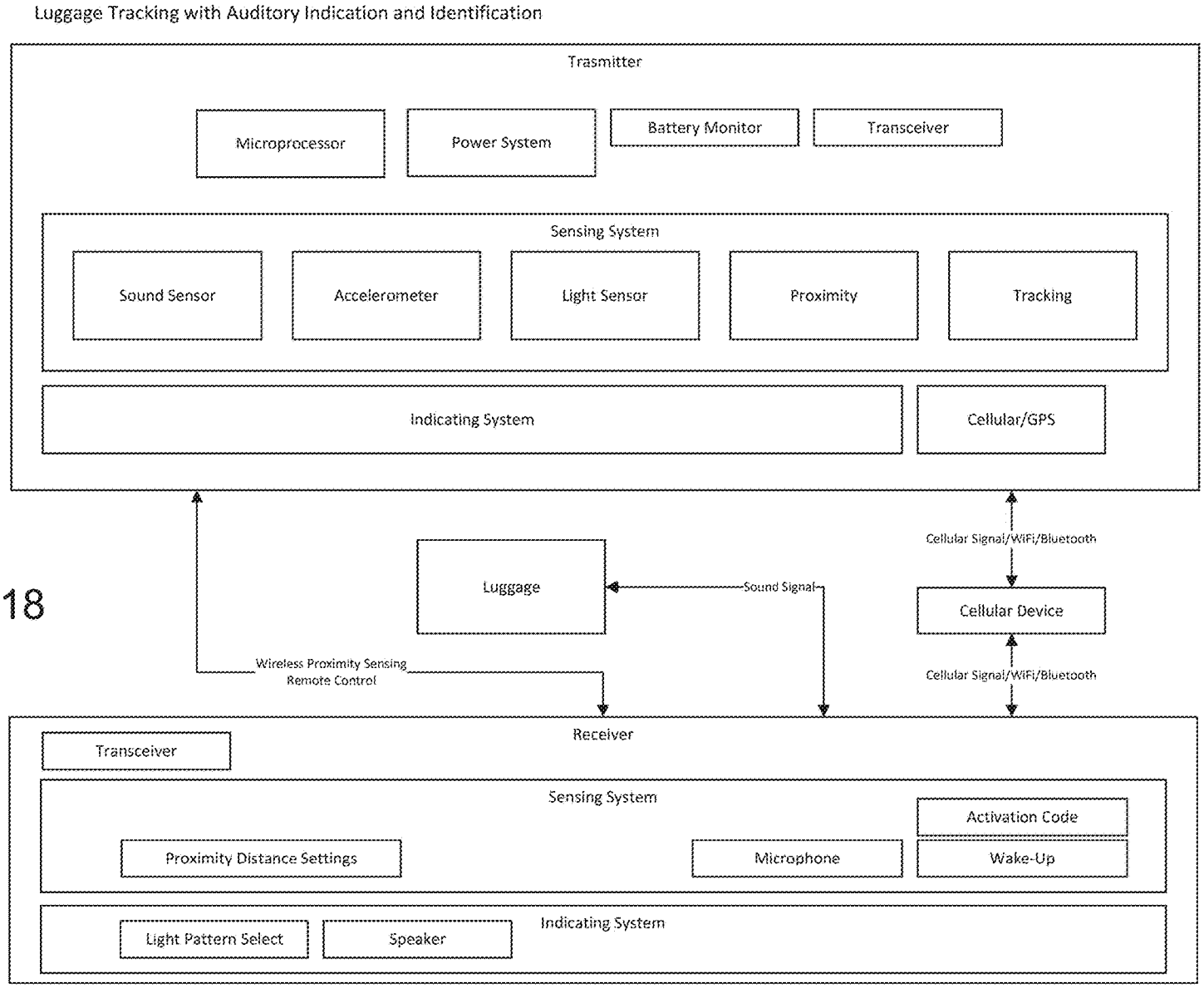
FIG. 18 is a block diagram of an illustrative system having luggage tracking with auditory indication and identification.
Figure 19:
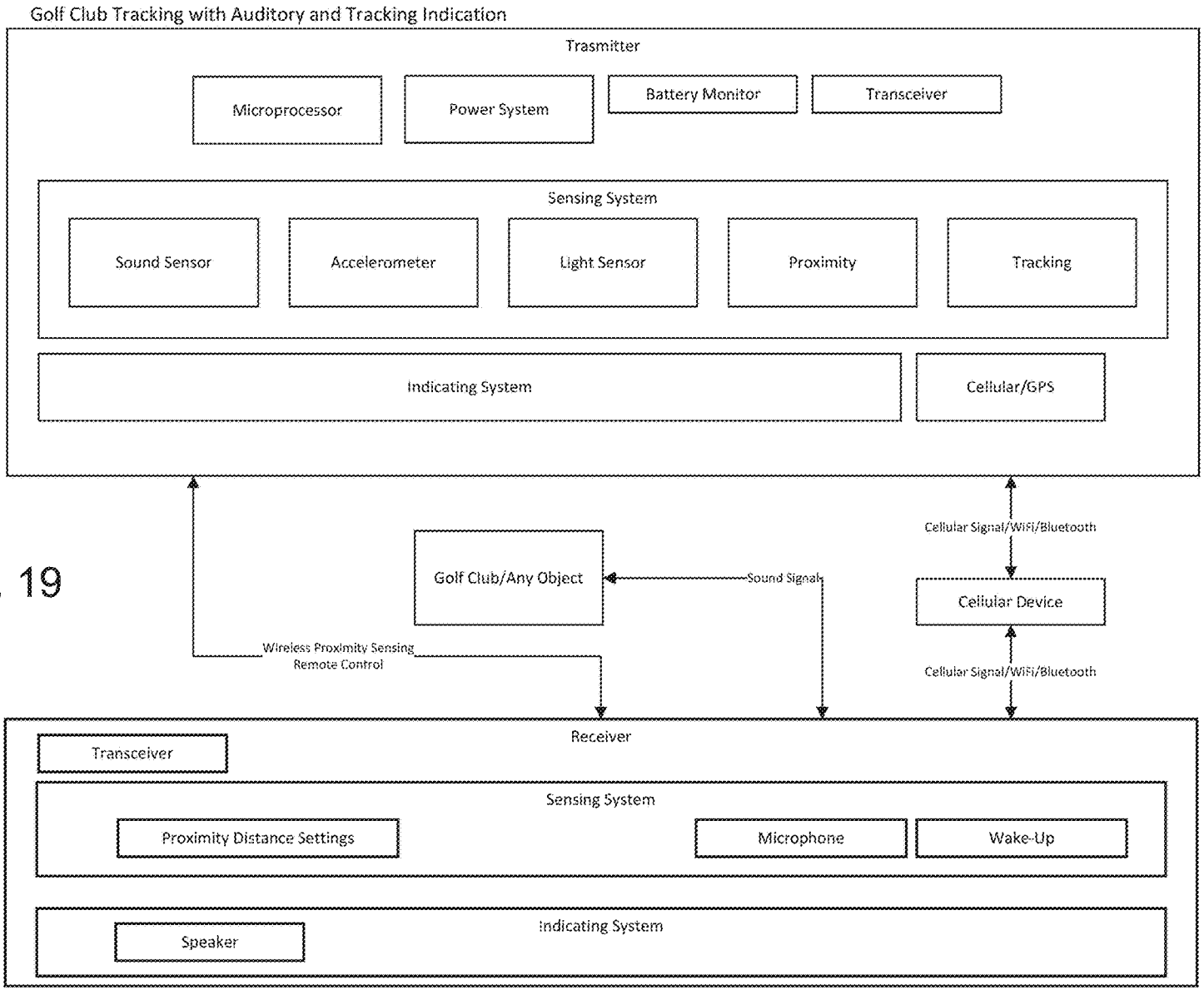
FIG. 19 is a block diagram of an illustrative system having golf club tracking with auditory and tracking indication.
Figure 20:
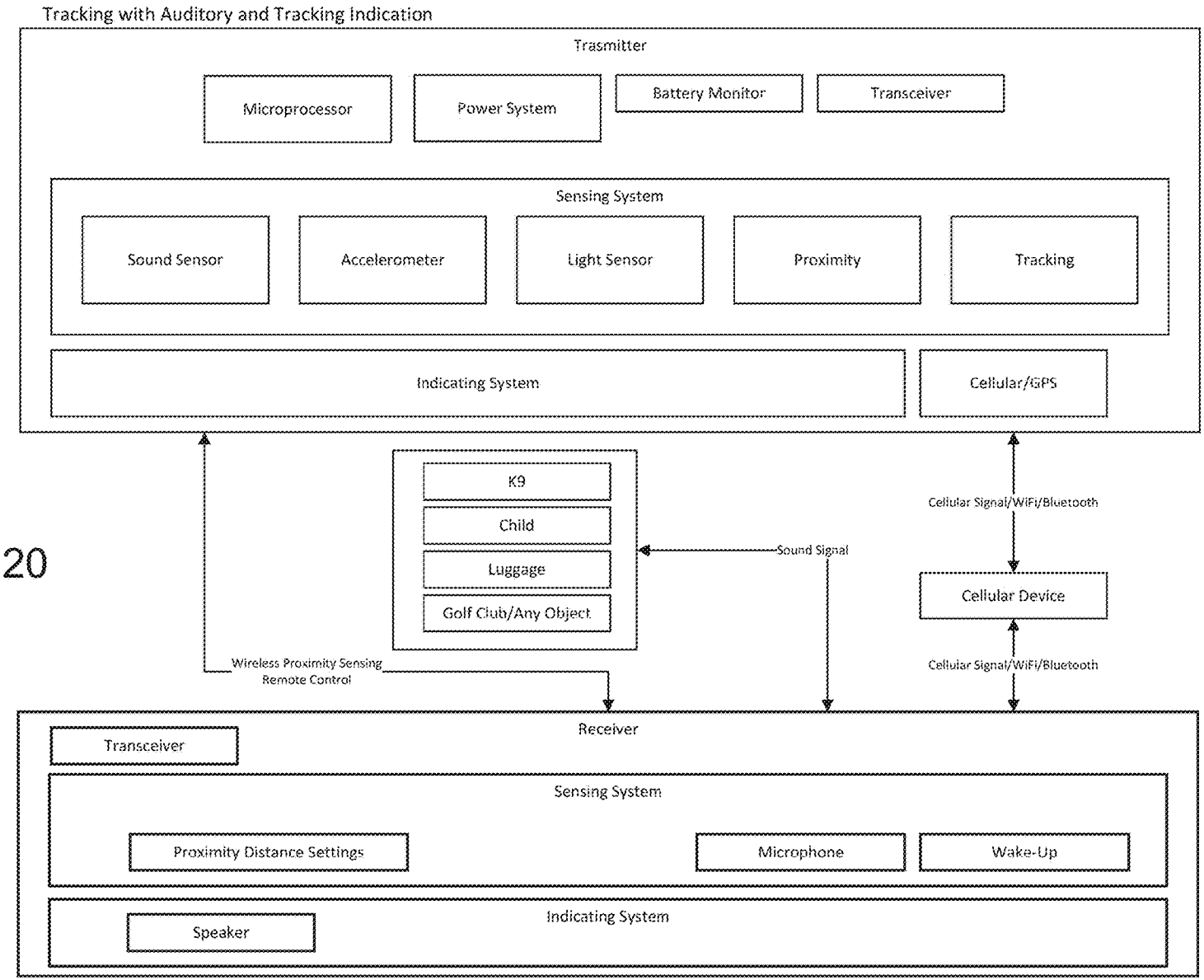
FIG. 20 is a block diagram of an illustrative system having tracking with auditory and tracking indication.
Figure 21:
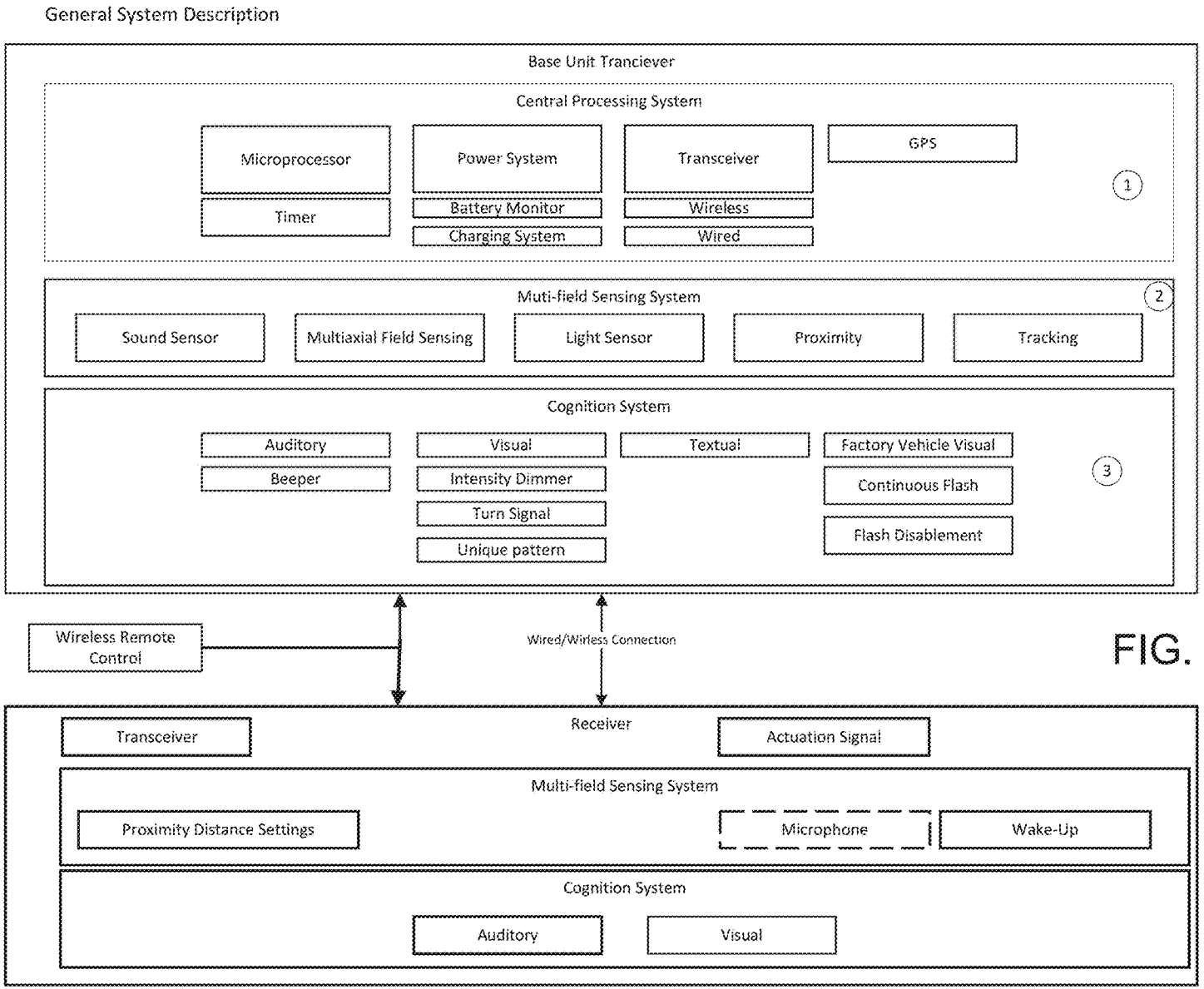
FIG. 21 is a block diagram of an illustrative system.
Figure 22:
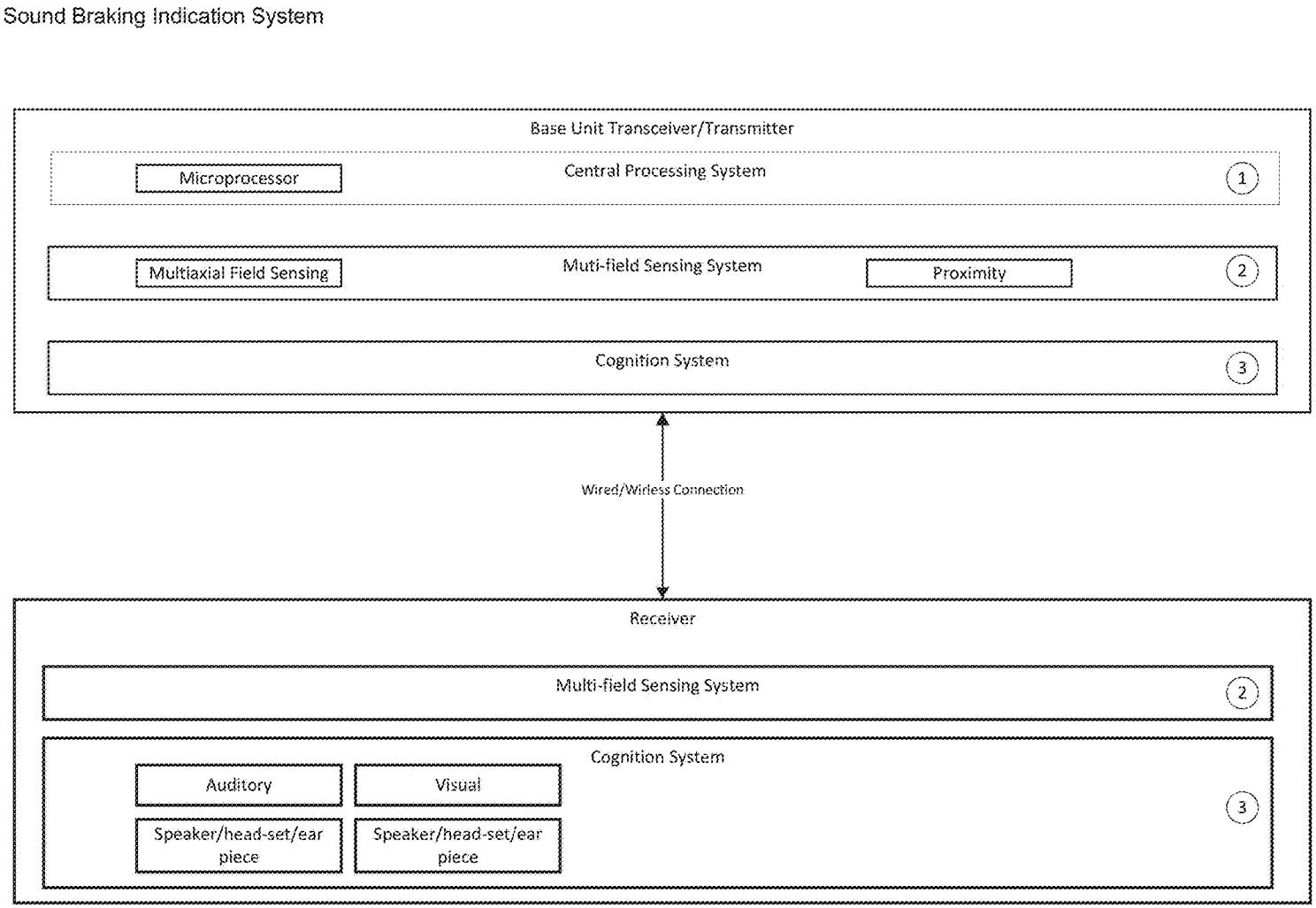
FIG. 22 is a block diagram of an illustrative system with sound braking indication system.
Figure 23:
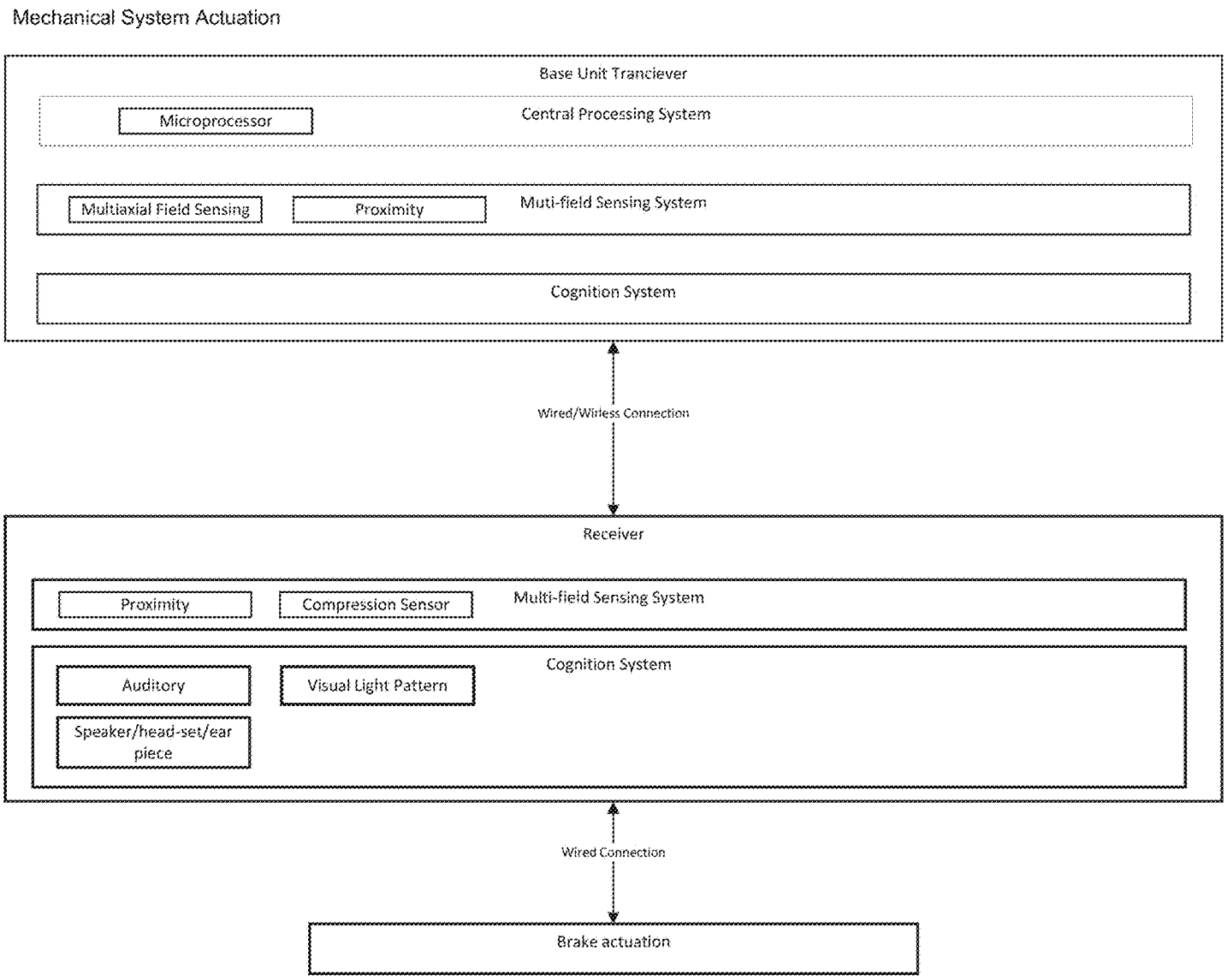
FIG. 23 is a block diagram of an illustrative system with mechanical system actuation.
Figure 24:
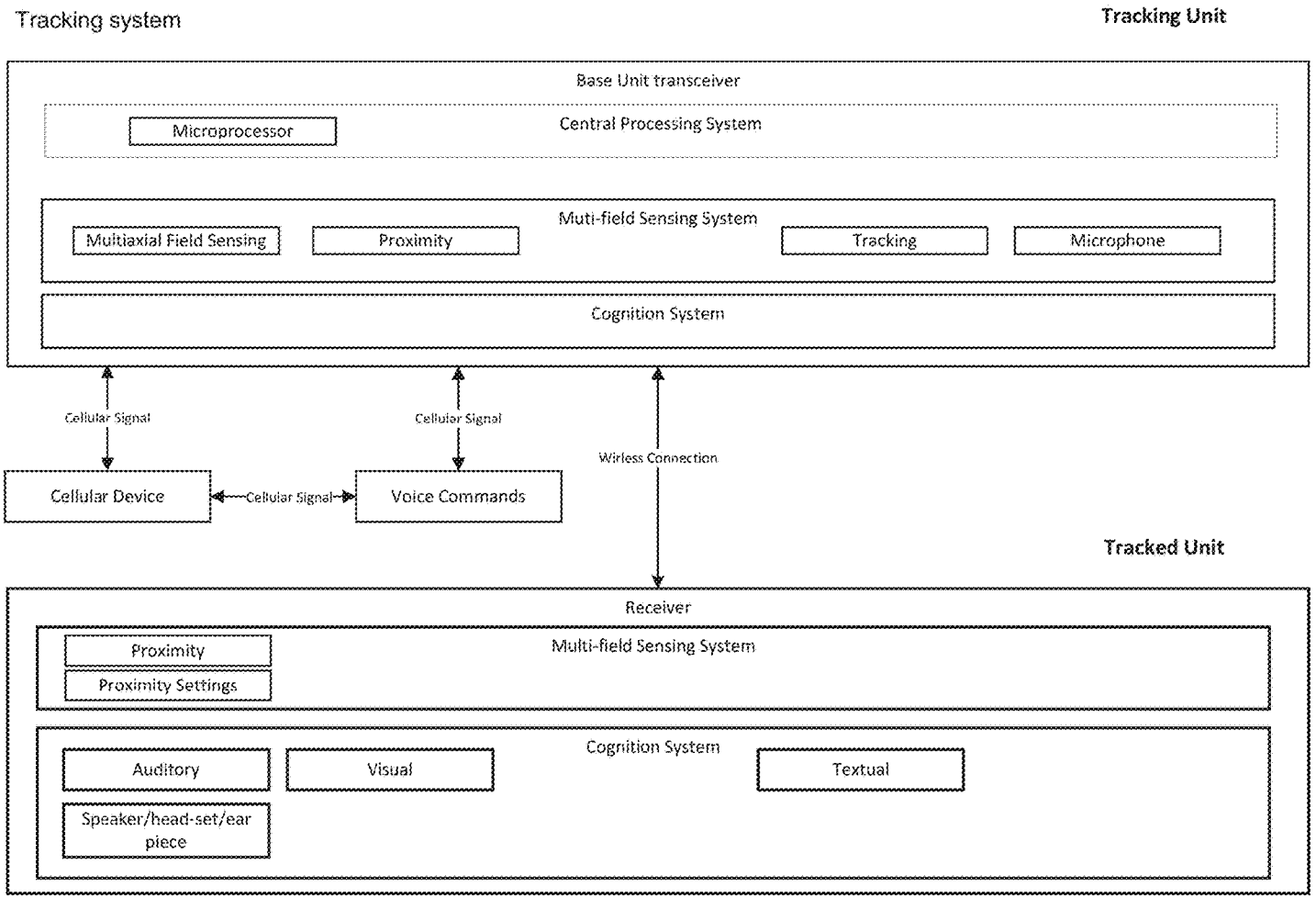
FIG. 24 is a block diagram of an illustrative system with tracking system.
Figure 25:
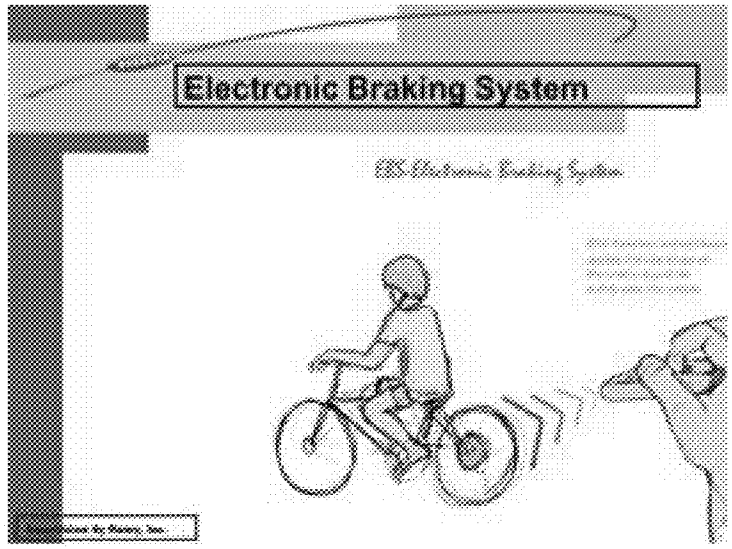
FIG. 25 is an illustration of an illustrative system in use on a bicycle.

Some embodiments can include the use of deceleration. Such embodiments, as in local unit 20, can be configured to be placed on the golf bag itself, but is not limited to that location. For example, the remote local unit 20 can have its own brake light (e.g., similar to those described in Patent '839 (see, e.g., FIG. 8)) within it. This brake light can be placed anywhere on the bag to provide the same deceleration detection and alert the cart behind the users of an intent to slow down or stop. Some such embodiments include a time clock that allows the user to determine a predetermined time of activation or a selectable time for how long the brake light will remain on.

Any of the embodiments disclosed herein can be or can employ an intelligent agent, e.g., a controller configured to control functions of the vehicle safety system based on data collected from the connected vehicle. As further example, a system may be connected to an SUV, which has a higher center of gravity than a car, or a vehicle with wearing parts (e.g., brakes, rotors, shocks, etc.). Such instances may cause variability in the data (e.g., movement of the vehicle) sensed by tilt sensors and accelerometers in the system: The same system installed in a car may experience less deflection than that installed on a SUV or in a car with worn parts. As well, driving styles (e.g., speed, braking distance, and braking frequency) can vary vastly between two drivers, even if they're in the same household and drive the same car. Data indicative of these variables and drivers can be collected and stored within the system. An illustrative system with an intelligent agent can learn and adjust components of the system to adapt to these variables in the environment, for instance, by adjusting the sensitivity of the sensors as described elsewhere herein based on data collected.

Embodiments disclosed herein may include a non-transitory computer readable medium. The non-transitory computer readable medium may have computer readable program code stored thereon. The computer readable program code can include one or more program instructions that, when executed by a processor, cause the processor to perform any function of the embodiments disclosed herein. For example, the non-transitory computer readable medium may include one or more program instructions that, when executed by a processor, cause the processor to perform functions similar to the intelligent agent. In some embodiments, the processor can be within a vehicle in which a particular embodiment is installed.

Figure 26A:
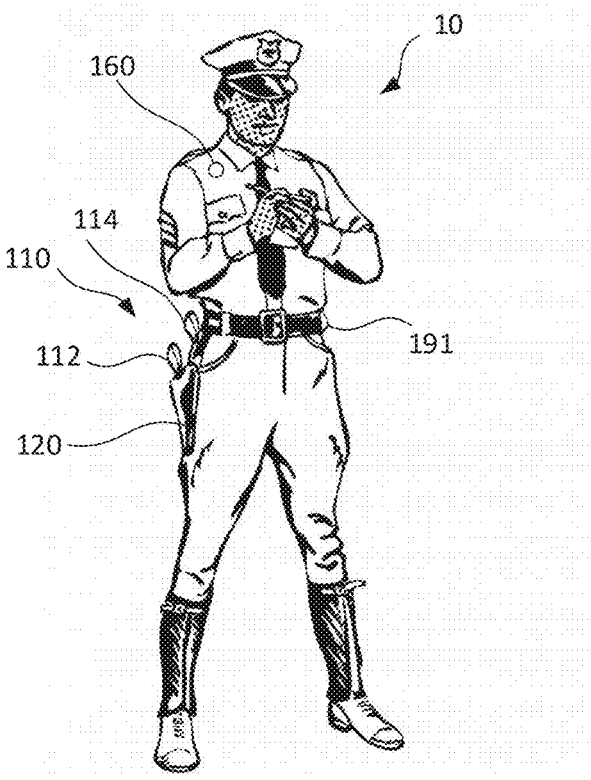
FIG. 26A is an illustration of a weapon release safety system worn by a bearer.
Figure 26B:
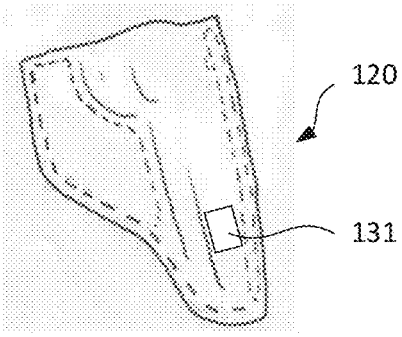
FIG. 26B is a perspective view of a storage for a weapon.
Figure 26C:
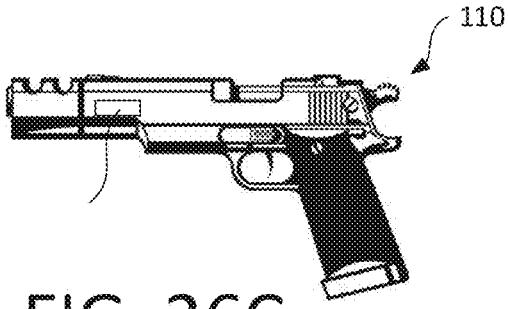
FIG. 26C is a side elevation view of a weapon that is a firearm.
Figure 26D:
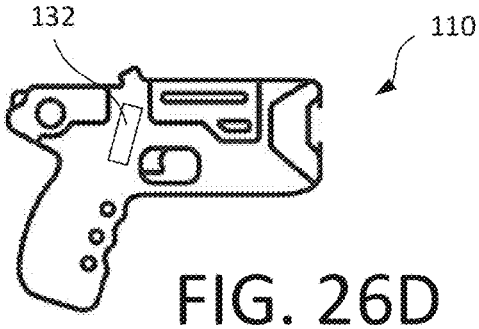
FIG. 26D is a side elevation view of a weapon that is a taser.
Figure 26F:
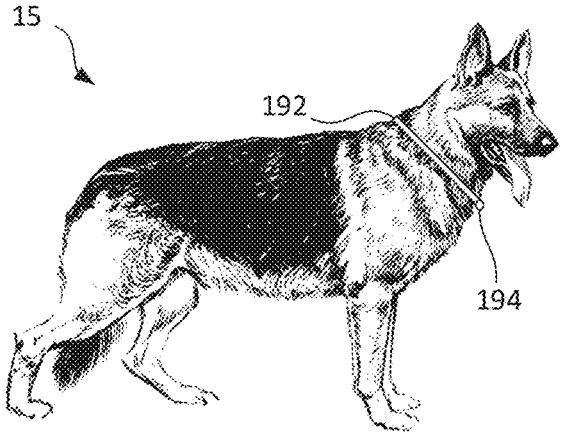
FIG. 26F is a perspective view of a service animal.
Figure 26E:
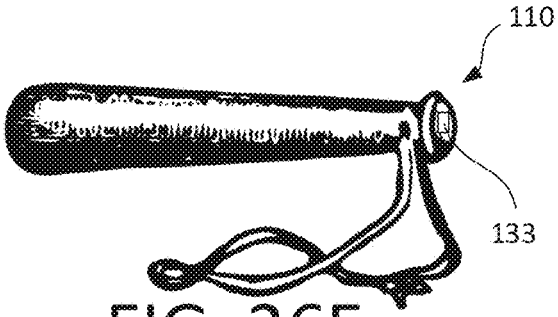
FIG. 26E is a perspective view of a weapon that is a baton.
Figure 26G:
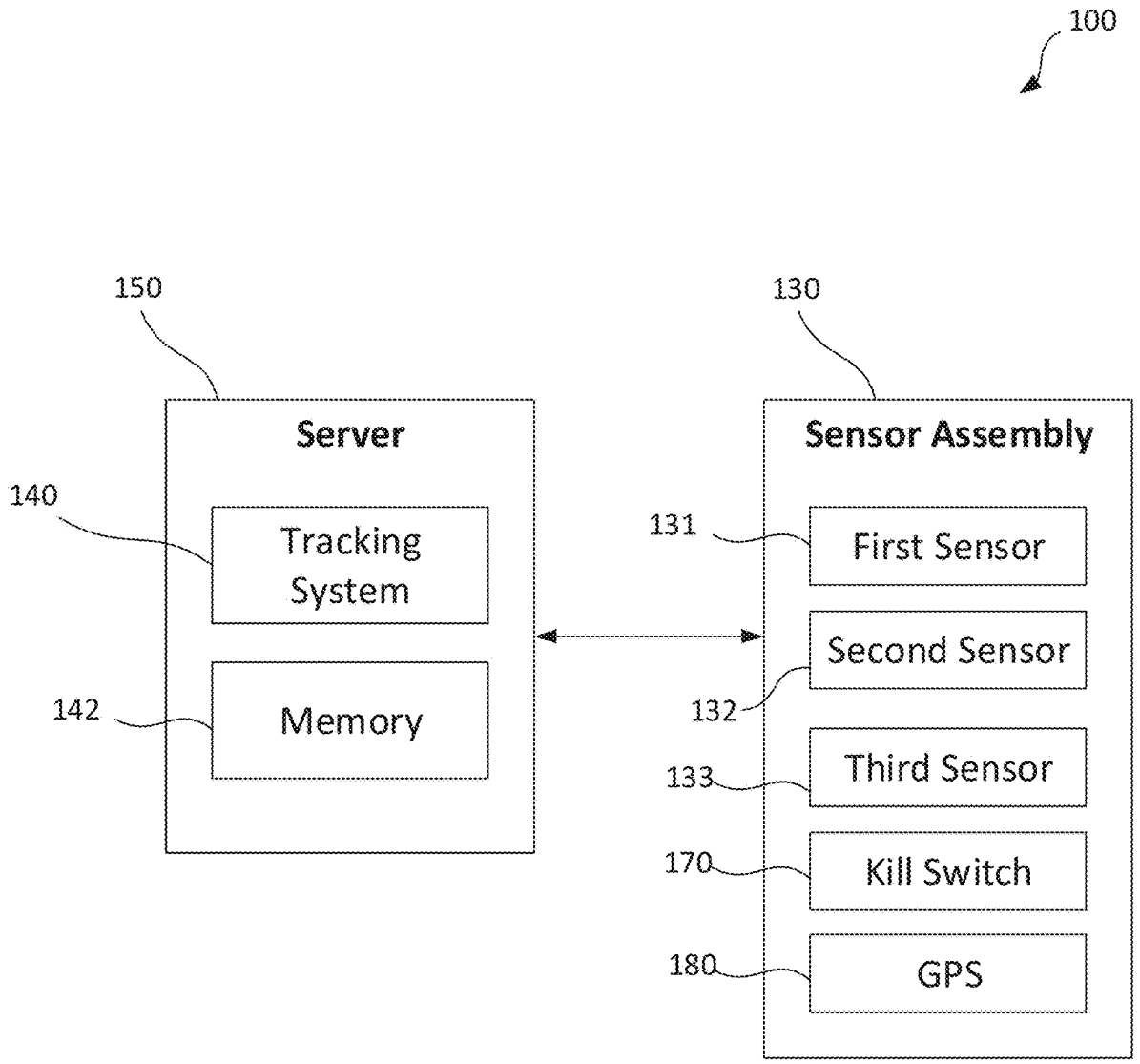
FIG. 26G is a block diagram of a weapon release safety system.
Figure 26H:
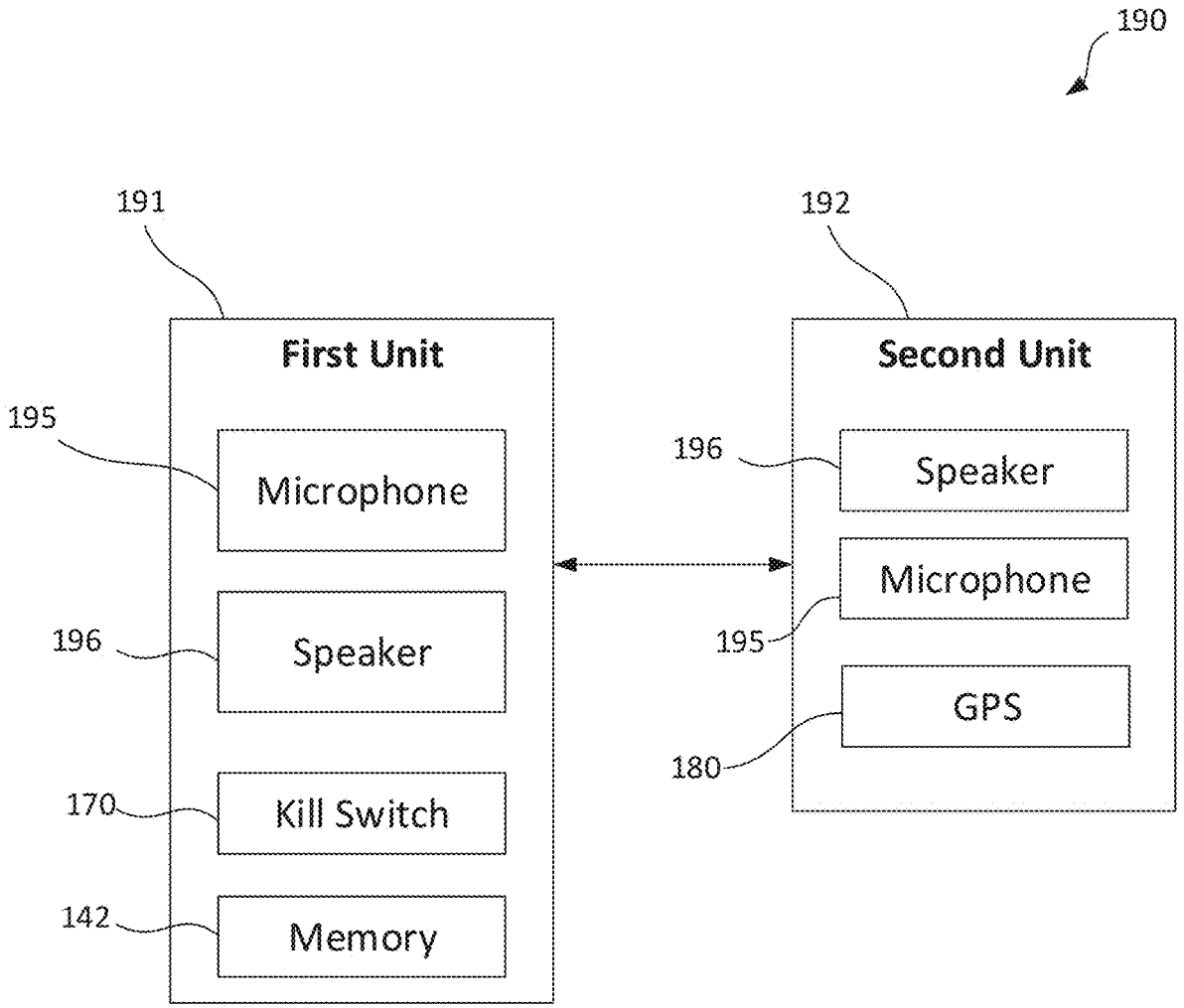
FIG. 26H is a block diagram of an animal safety system.

FIGS. 26A-F show various features of a weapon release safety system 100 according to embodiments of the present disclosure. FIG. 26A is an illustration of a weapon release safety system 100 worn by a bearer 10 that is a law enforcement officer. FIG. 26B is a perspective view of a storage 120 for a weapon 110. FIG. 26C is a side elevation view of a weapon 110 that is a firearm. FIG. 26D is a side elevation view of a weapon 110 that is a taser. FIG. 26E is a perspective view of a weapon 110 that is a baton. FIG. 26F is a perspective view of a service animal 15. FIG. 26G is a block diagram showing weapon release safety system 100. FIG. 26H is a block diagram of an animal safety system 190.

The present disclosure includes a weapon release safety system 100, in accordance with principles of the present disclosure. The weapon release safety system 100 comprises an active state, an inactive state, and a tracking system 140. When in the inactive state, the weapon release safety system 100 can indicate that a weapon 110 has not been drawn from a storage 120 therefor. When in the active state, the weapon release safety system 100 can indicate that the weapon 110 has been drawn from the storage 120 therefor. The weapon release safety system 100 can be in the inactive state while the weapon 110 is within a proximity of the storage 120, and the weapon release safety system 100 can be in the active state while the weapon 110 is not within the proximity of the storage 120. The tracking system 140 can be a server, computer, controller, processor, or the like and configured to track a number of times that the weapon 110 has been drawn from the storage 120 by a bearer 10. The weapon release safety system 100 can include a sensor assembly configured to cause the weapon release safety system 100 to move between the inactive state and the active state. The weapon release safety system 100 can remain in the active state so long as the weapon 110 is not within the proximity of the storage 120. Information from the tracking system 140 (or other information received or transmitted by the server) can be stored in memory 142.

In embodiments, the sensor assembly can include a first sensor 131 attached to the storage 120 and a second sensor 132 attached to the weapon 110. The weapon 110 can be a primary weapon 112 or a secondary weapon 114. The sensor assembly can include a third sensor 133 attached to the other of the primary weapon 112 and the secondary weapon 114 than the second sensor 132. A frequency at which the second sensor 132 operates can be the same frequency at which the third sensor 133. The weapon 110 can be a taxer, a baton, or a firearm. An adaptor (not shown) may allow for the sensors to be place on the weapon 110, on the storage 120, or another location in which the proximity of the weapon 110 is meaningful for the user, for example, at a precinct or a patrol vehicle (as mentioned above). Any of the sensors may be placed on their respective components at a position that facilitates communication between sensors and/or a server.

A number of safety and/or convenience features are disclosed in the present disclosure. For example, the weapon release safety system 100 can include a safety light 160 configured to alert surroundings of a wearer's presence and to deactivate when the weapon release safety system 100 is in the active state. The safety light 160 may be included on at least one of the weapon 110 or the storage 120 (e.g., to alert a user of the weapon 110's or storage 120's presence when lost). The weapon release safety system 100 can include a kill switch 170 configured to override the alert of the safety light 160. The weapon release safety system 100 can be configured to be in operative communication with a server and to enter a maintenance mode (e.g., for cleaning or near the server or for inspections) in which the weapon release safety system 100 is inhibited from entering the active state when in a proximity of the server and to exit the maintenance mode in which the weapon release safety system 100 is allowed to enter the active state when outside of the proximity of the server. With respect to inhibiting the weapon release safety system 100 from entering the active state, a default setting may be to automatically enter maintenance mode when in the proximity of the server and to allow a user to manually (e.g., by actuating an actuator such as a button or switch) exit maintenance mode to have the weapon release safety system 100 operate normally while in proximity of the server. In examples, a user may manually enter and/or exit maintenance mode while away from the server or even while in proximity of the server. For easy identification, the weapon release safety system 100 may include an indicator (e.g., a solid light, a flashing light, a sound, a mechanical feature, etc.) that indicates to the user that the weapon release safety system 100 is in maintenance mode. The weapon release safety system 100 can be configured to provide an alert to the server when in the active state. The weapon release safety system 100 can include a GPS 180 for determining a location of the bearer 10 and the alert includes the location of the bearer 10. The server can include the tracking system 140, and the tracking system 140 can be configured to track a time at which the weapon 110 was drawn from the storage 120 and a location at which the storage 120, the weapon 110, or both were last used. Such features may be useful in finding the weapon 110 when the weapon 110 is lost or otherwise taken.

The present disclosure includes an animal safety system 190, in accordance with principles of the present disclosure. The animal safety system 190 and include a first unit 191, a second unit 192, and a signal 194. The first unit 191 can be configured to attach to an animal 15. The second unit 192 can be in operative communication with the first unit 191 and configured to detect a proximity of the first unit 191 to the second unit 192 and to provide commands to the first unit 191 in response thereto. The signal 194 can be in operative communication with the first unit 191, the second unit 192, or both and configured to alert surroundings of a presence of the bearer 10. The animal safety system 190 can include a kill switch 170 configured to override the signal 194. The signal 194 can include a light with a selectable flash rate such that the light is made to flash solid, rhythmically, or randomly. The animal safety system 190 can be in communication with the server.

In embodiments, the animal safety system 190 can be configured to transmit sound from a user to a bearer 10. The sound can include inaudible sounds. The sound can include audible sounds. The audible sounds can be transmitted commands of the user to the bearer 10. The sound can be transmitted via a software application. The software application can be run on a smartphone. Sound may be transmitted via a microphone and speaker combination and transmission can be one way or two way. Transmitted information may be stored in a memory 142.

In the foregoing detailed description, the invention has been described with reference to specific embodiments. However, it may be appreciated that various modifications and changes can be made without departing from the scope of the invention as set forth in the appended claims. Thus, some of the features of preferred embodiments described herein are not necessarily included in embodiments of the invention which are intended for alternative uses. Various modifications and additions may be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A weapon release safety system comprises:

an inactive state in which the weapon release safety system indicates that a weapon has not been drawn from a storage therefor; and an active state in which the weapon release safety system indicates that the weapon has been drawn from the storage therefor;

wherein the weapon release safety system is in the inactive state while the weapon is within a proximity of the storage and wherein the weapon release safety system is in the active state while the weapon is not within the proximity of the storage; and wherein a tracking system is configured to track a number of times that the weapon has been drawn from the storage by a bearer;

the weapon release safety system further comprising a sensor assembly that is configured to detect the presence of the weapon within the proximity of the storage such that the weapon release safety system toggles between the active and inactive states, and wherein the weapon release safety system is configured to be in operative communication with a server and the tracking system is integrated into the server.

2. The weapon release safety system of claim 1, wherein the sensor assembly is configured to cause the weapon release safety system to move between the inactive state and the active state without any physical contact with the weapon.

3. The weapon release safety system of claim 1, wherein a first sensor of the sensor assembly is attached to the storage and the sensor assembly further comprises a second sensor attached to the weapon, wherein the weapon is a primary weapon or a secondary weapon.

4. The weapon release safety system of claim 3, wherein the sensor assembly further comprises a third sensor attached to the other of the primary weapon and the weapon than the second sensor, and wherein a frequency of the second sensor is the same frequency as the third sensor.

5. The weapon release safety system of claim 1, wherein the weapon release safety system further comprises a safety light configured to alert surroundings of a presence the bearer and to deactivate when the weapon release safety system is in the active state.

6. The weapon release safety system of claim 5, the weapon release safety system further comprises a kill switch configured to override the alert of the safety light.

7. The weapon release safety system of claim 1, wherein the weapon release safety system is configured to be in operative communication with a server and to enter a maintenance mode in which the weapon release safety system is inhibited from entering the active state when in a proximity of the server and to exit the maintenance mode in which the weapon release safety system is allowed to enter the active state when outside of the proximity of the server, and wherein the weapon release safety system is configured to provide an alert to the server when in the active state.

8. The weapon release safety system of claim 7, wherein the weapon release safety system further comprises a GPS for determining a location of the bearer and the alert includes the location of the bearer.

9. The weapon release safety system of claim 1, wherein the weapon release safety system remains in the active state so long as the weapon is not within the proximity of the storage.

10. The weapon release safety system of claim 1, wherein a server comprises the tracking system, and the tracking system is further configured to track a time at which the weapon was drawn from the storage and a location at which the storage, the weapon, or both were last used.

11. A weapon release safety system comprises:

an inactive state in which the weapon release safety system indicates that a weapon has not been drawn from a storage therefor; and an active state in which the weapon release safety system indicates that the weapon has been drawn from the storage therefor;

wherein the weapon release safety system is in the inactive state while the weapon is within a proximity of the storage and wherein the weapon release safety system is in the active state while the weapon is not within the proximity of the storage; and wherein a tracking system is configured to track a number of times that the weapon has been drawn from the storage by a bearer;

the weapon release safety system further comprising a sensor assembly that is configured to detect the presence of the weapon within the proximity of the storage such that the weapon release safety system toggles between the active and inactive states, the weapon release safety system being configured to be in operative communication with a server and to enter a maintenance mode in which the weapon release safety system is inhibited from entering the active state when in a proximity of the server so as to indicate to the tracking system that the weapon has been drawn from the storage therefor for maintenance.

12. The weapon release safety system of claim 11, wherein the weapon release safety system is further configured to exit the maintenance mode in which the weapon release safety system is allowed to enter the active state when outside of the proximity of the server.

13. The weapon release safety system of claim 11, wherein by default the weapon release safety system automatically enters maintenance mode when in the proximity of the server.

14. The weapon release safety system of claim 13, wherein the weapon release safety system is further configured to allow a user to manually exit maintenance mode to have the weapon release safety system operate normally while in the proximity of the server.

15. The weapon release safety system of claim 11, further comprising an indicator that indicates to the user that the weapon release safety system is in maintenance mode.

16. The weapon release safety system of claim 11, wherein the weapon release safety system is further configured to provide an alert to the server when in the active state and a location of the bearer.

17. The weapon release safety system of claim 11, wherein the tracking system is configured to track at least one of a time at which the weapon was drawn from the storage, a location at which the storage was last used, and a location at which the weapon was last used.

18. The weapon release safety system of claim 11, wherein the weapon release safety system uplinks an emergency message to the server to indicate that the weapon has been drawn and to send back up to the location of the weapon.

19. The weapon release safety system of claim 11, wherein the tracking system provides an indication of whose weapon has been drawn and the server is configured to generate a pattern of behavior of an officer indicating when the officer has unnecessarily drawn a weapon.

20. The weapon release safety system of claim 11, wherein the storage is a gun case.

* * * * *